US007387862B2

(12) United States Patent
Toriyama et al.

(10) Patent No.: US 7,387,862 B2
(45) Date of Patent: Jun. 17, 2008

(54) ELECTROPHOTOGRAPHIC PHOTORECEPTOR AND IMAGE FORMING APPARATUS PROVIDING THE SAME

(75) Inventors: Koichi Toriyama, Yao (JP); Kotaro Fukushima, Kawanishi (JP); Hisayuki Utsumi, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 403 days.

(21) Appl. No.: 11/134,298

(22) Filed: May 23, 2005

(65) Prior Publication Data

US 2005/0266327 A1 Dec. 1, 2005

(30) Foreign Application Priority Data

May 25, 2004 (JP) ..... P2004-154918

(51) Int. Cl.
*G03G 5/147* (2006.01)

(52) U.S. Cl. ..... 430/58.35; 430/73; 430/74

(58) Field of Classification Search ..... 430/58.35, 430/73, 74

See application file for complete search history.

(56) References Cited

U.S. PATENT DOCUMENTS

| | | | | |
|---|---|---|---|---|
| 4,284,485 | A * | 8/1981 | Berner | 522/42 |
| 4,308,400 | A | 12/1981 | Felder et al. | |
| 4,315,807 | A | 2/1982 | Felder et al. | |
| 4,318,791 | A | 3/1982 | Felder et al. | |
| 4,321,118 | A | 3/1982 | Felder et al. | |
| 4,952,470 | A | 8/1990 | Tamaki et al. | |
| 5,102,759 | A | 4/1992 | Fuse et al. | |
| 5,130,222 | A | 7/1992 | Otsuka et al. | |
| 2005/0287455 | A1 * | 12/2005 | Uchino et al. | 430/60 |

FOREIGN PATENT DOCUMENTS

| | | | |
|---|---|---|---|
| JP | 62-9124 | B2 | 2/1987 |
| JP | 62-105151 | A | 5/1987 |
| JP | 63-4238 | A | 1/1988 |
| JP | 63-18355 | A | 1/1988 |
| JP | 63-216055 | A | 9/1988 |
| JP | 1-34242 | B2 | 7/1989 |
| JP | 3-172852 | A | 7/1991 |
| JP | 8-184980 | A | 7/1996 |

* cited by examiner

*Primary Examiner*—John L Goodrow
(74) *Attorney, Agent, or Firm*—Nixon & Vanderhye P.C.

(57) ABSTRACT

An electrophotographic photoreceptor is provided that in excellent in the electrical characteristics such as the charging property, the sensitivity and the responsiveness, the oxidizing gas resistance such as the ozone resistance and the nitrogen oxide resistance, and the electrical durability such that even after repetition use the foregoing excellent electrical characteristics are not deteriorated. A photosensitive layer of an electrophotographic photoreceptor contains an amine compound represented by the general formula (1).

(1)

3 Claims, 7 Drawing Sheets

ELECTROPHOTOGRAPHIC PHOTORECEPTOR AND IMAGE FORMING APPARATUS PROVIDING THE SAME

BACKGROUND OF THE INVENTION

1. Field of the Invention

The present invention relates to an electrophotographic photoreceptor that is used to form an image according to an electrophotography process and image forming apparatus providing the same 2. Description of the Related Art In electrophotographic image forming apparatus used frequently as copy machines and printers, a surface of an electrophotographic photoreceptor (hereinafter simply referred to as photoreceptor as well) is charged uniformly by a charging unit, the surface is exposed to form an electrostatic latent image corresponding to image information, the electrostatic latent image is developed with fine particles called toner to form a toner image that is a visible image, a formed toner image is transferred on a toner receiving material such as transfer paper and fixed, and thereby an image is formed on the toner receiving material.

An electrophotographic photoreceptor is formed by laminating a photosensitive layer including a photoconductive material on an electrically conductive substrate. As a photoconductive material of the electrophotographic photoreceptor, so far, inorganic photoconductive materials such as selenium (Se), cadmium sulfide (CdS) and zinc oxide ($ZnO_2$) have been used. However, since there are problems of toxicity and so on in these inorganic photoconductive materials, in recent years, electrophotographic photoreceptors that use an organic photoconductive material (hereinafter in some cases referred to as organic photoreceptor) that is nontoxic, excellent in the film forming property and wide in a material selection range have been actively developed.

As the organic photoreceptor, a functionally-separated photoreceptor in which a charge generation function and a charge transport function, respectively, are carried out by different substances is used. The functionally-separated photoreceptor is roughly divided into a single layer photoreceptor that has a photosensitive layer in which a charge generating substance that has the charge generation function and a charge transporting substance that has the charge transport function are dispersed together in a resin that is called a binder resin and has the binding property; and a laminate type photoreceptor that has a photosensitive layer in which a charge generation layer in which a charge generating substance is dispersed and a charge transport layer in which a charge transporting substance is dispersed are laminated.

The laminate type photoreceptor has advantages in that a photosensitive layer can be easily designed and an electrophotographic photoreceptor excellent in the sensitivity and stability can be relatively readily prepared; accordingly, the laminate type photoreceptor forms a main stream of the organic photoreceptors. Furthermore, the single layer photoreceptor, since the photosensitive layer is formed of a single layer, in comparison with the laminate type photoreceptor, is higher in the productivity, can be manufactured at lower manufacturing costs, and, since a positive charge process in which at charging ozone that is a hazardous material is generated with difficulty can be used, is being put into practical use.

As performance required for an electrophotographic photoreceptor in an image forming process, the superiority in the electrical characteristics such as the charging property, the sensitivity and the responsiveness can be cited. Furthermore, in the image forming apparatus, since the image forming process is repeated many times, the photoreceptor is demanded to be stable in the electrical characteristics and excellent in the electrical durability even in repetition use.

However, existing photoreceptors have disadvantages in that the electrical durability is insufficient and when the photoreceptors are repeatedly used, the fatigue and deterioration such as a decrease in the charging potential, an increase in the rest potential and deterioration of the sensitivity are caused to induce deterioration of image quality, resulting in being incapable of using over a long term.

Regarding reasons for the fatigue and deterioration of the photoreceptor, several factors can be cited. Among these, an influential factor is in that oxidizing gases such as ozone, nitrogen oxides, chlorine oxides, and sulfur oxides that are emitted from a corona discharge type charging device (herein after referred to as corona discharger) that is used as charging means when a photoreceptor is charged in the image forming process greatly damage a photosensitive layer. It is considered that the oxidizing gases react with a charge transport material to generate ion pairs that accompany electron transfer or are absorbed by the charge generation material to induce a decrease in the charging potential, an increase in the rest potential, deterioration of the sensitivity, and deterioration of the resolution power owing to a decrease in the surface resistance. As a result, the image quality is remarkably deteriorated and the lifetime of the photoreceptor is shortened.

In order to overcome the problem of the fatigue and deterioration of the photoreceptor due to the oxidizing gases, an idea is proposed in that the oxidizing gases generated from a corona discharger is efficiently evacuated and replaced by an inert gas to a photosensitive layer, and thereby an adverse affect of the oxidizing gases on the photoreceptor is suppressed. However, in order to evacuate the oxidizing gases, an evacuation unit has to be newly disposed in the image forming apparatus. However, a problem causes that a process as a whole and a system becomes complicated.

Furthermore, in order to suppress the fatigue and deterioration of the photoreceptor from occurring owing to the oxidizing gases, a particular compound is added to a photosensitive layer. It is proposed to add, for instance, an anti-oxidant such as a hindered phenol compound (Japanese Unexamined Patent Publication JP-A 62-105151 (1987)) and an aromatic amine compound such as N,N'-diphenyl-p-phenylene diamine (Japanese Unexamined Patent Publication JP-A 63-216055 (1988)); and a light stabilizer such as a hindered amine compound (Japanese Unexamined Patent Publication JP-A 63-18355 (1988)) and a benzotriazole compound to a photosensitive layer. Here, the hindered phenol compound is a phenol compound that has a bulky substituent group such as a side chain-like alkyl group, cyclo-alkyl group, aryl group or heterocyclic group in an ortho-position of a phenolic hydroxy group. Furthermore, the hindered amine compound is an amine compound in which a hydrogen atom of an amino group is substituted with a bulky substituent group such as a side chain-like alkyl group, cyclo-alkyl group, aryl group or heterocyclic group.

Furthermore, in different related art, it is proposed to add a trialkyl amine compound (Japanese Unexamined Patent Publication JP-A 63-4238 (1988)), a t-amine compound having a particular structure such as 2-(N,N-dibenzylamino) ethanol (Japanese Unexamined Patent Publication JP-A 03-172852 (1991)) and the like to a photosensitive layer.

The photoreceptors disclosed in the JP-A Nos. 62-105151, 63-216055, 63-18355, 63-4238 and 03-172852 have problems as shown below. Even though compounds disclosed in JP-A Nos. 62-105151, 63-216055, 63-18355, 63-4238 and 03-172852 are used, the fatigue and deterioration of the photoreceptor due to the oxidizing gases such as ozone and nitrogen oxides cannot be sufficiently suppressed from occurring; that is, after the repeated use thereof, the decrease of the charging potential and the increase of the rest potential are generated. Furthermore, when the compounds disclosed in JP-A Nos. 62-105151, 63-216055, 63-18355, 63-4238 and 03-172852 are added to a photosensitive layer, the deterioration of the sensitivity and the deterioration of the electrical characteristics such as the increase of the rest potential owing to the deterioration of the responsiveness are caused; accordingly, there is a problem that from the beginning of use, practically sufficient sensitivity and responsiveness cannot be obtained.

SUMMARY OF THE INVENTION

An object of the invention is to provide an electrophotographic photoreceptor that is excellent in the electrical characteristics such as the charging property, the sensitivity and the responsiveness, the oxidizing gas resistance such as the ozone resistance and the nitrogen oxide resistance, and the electrical durability that even after repetition use the foregoing excellent electrical characteristics do not deteriorate; and image forming apparatus providing the same.

The invention provides an electrophotographic photoreceptor comprising an electrically conductive substrate; and a photosensitive layer including a charge generation material and a charge transport material, disposed on the electrically conductive substrate, wherein the photosensitive layer includes an amine compound represented by the following general formula (1).

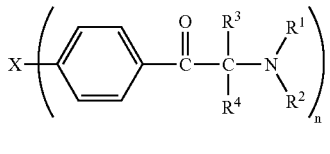

(1)

(In the formula, $R^1$ and $R^2$, respectively, represent an alkyl group, a cycloalkyl group, a heterocycloalkyl group or an aralkyl group each of which may have a substituent group. $R^3$ and $R^4$, respectively, represent an alkyl group that may have an alkoxycarbonyl group as a substituent group and an aralkyl group that may have a substituent group. n denotes an integer of 1 or 2. X, when n is 1, represents a hydrogen atom, a halogen atom, a hydroxyl group, an alkyl group, an alkoxy group, an alkylthio group, an alkylsulfonyl group, a phenylthio group, a phenoxy group or a substituted amino group represented by $—NR^5R^6$ ($R^5$ and $R^6$, respectively, represent an alkyl group that may have an alkoxy group as a substituent group, an aryl group or an alkylene group that when couples each other may have an oxygen atom, an imino group or a N-alkylimino group between carbon atoms); and, when n is 2, represents —O—, —S— or an alkylene group.)

Furthermore, in the invention, in the general formula (1), $R^3$ and $R^4$, respectively, represent an alkyl group that has 1 to 8 carbon atoms and may have an alkoxycarbonyl group having 2 to 5 carbon atoms as a substituent group, or a phenylalkyl group having 7 to 9 carbon atoms; and

X, when n is 1, represents a hydrogen atom, a halogen atom, a hydroxyl group, an alkyl group having 1 to 4 carbon atoms, an alkoxy group having 1 to 4 carbon atoms, an alkylthio group having 1 to 4 carbon atoms, an alkylsulfonyl group having 1 to 4 carbon atoms, a phenylthio group, a phenoxy group, or a substituted amino group represented by $—NR^{5a}R^{6a}$ ($R^{5a}$ and $R^{6a}$, respectively, represent an alkyl group having 1 to 12 carbon atoms, an alkyl group that has 2 to 4 carbon atoms and an alkoxy group having 1 to 4 carbon atoms as a substituent group, an aryl group, or an alkylene group that has 4 to 5 carbon atoms and, when couples each other, may have an oxygen atom, an imino group or a N-alkylimino group having 1 to 4 carbon atoms between carbon atoms); and, when n is 2, represents —O—, —S— or an alkylene group having 1 to 4 carbon atoms.

Still furthermore, in the invention, in the general formula (1), $R^1$ and $R^2$, respectively, represent an alkyl group having 1 to 4 carbon atoms;

$R^3$ and $R^4$, respectively, represent an alkyl group that has 1 to 8 carbon atoms and may have an alkoxycarbonyl group having 2 to 5 carbon atoms as a substituent group, or an alkylphenyl group having 7 to 9 carbon atoms;

n is 1; and

X represents a hydrogen atom or an alkylene group that has 4 to 5 carbon atoms and an oxygen atom between carbon atoms when, in $—NR^5R^6$, $R^5$ and $R^6$ couple each other.

Furthermore, in the invention, the photosensitive layer includes a charge generation layer containing a charge generation material and a charge transport layer containing a charge transport material, wherein at least one of the charge generation layer and the charge transport layer includes an amine compound represented by a general formula (1).

Still furthermore, in the invention, the photosensitive layer includes 1 part by weight or more and 20 parts by weight or less of an amine compound represented by a general formula (1) relative to 100 parts by weight of a charge transport material.

Furthermore, the invention provides an image forming apparatus comprising:

the electrophotographic photoreceptor described above;

charging means for charging the electrophotographic photoreceptor;

exposure means for applying exposure to the charged electrophotographic photoreceptor; and developing means for developing an electrostatic latent image formed by exposure.

According to the invention, a photosensitive layer of an electrophotographic photoreceptor (hereinafter also referred to simply as a photoreceptor) includes an amine compound represented by the general formula (1). In the invention, the photosensitive layer is used in the meaning including all of a photosensitive layer that is constituted of a single layer photoconductive layer made of a single layer including a charge generation material and a charge transport material, a photosensitive layer that is constituted of a laminate photoconductive layer in which a charge generation layer containing a charge generation material and a charge transport layer containing a charge transport material are laminated, and a photosensitive layer that is provided with the single layer photoconductive layer or the laminate layer photoconductive layer and an intermediate layer and/or a surface protective layer described below.

When a photosensitive layer is allowed to contain an amine compound represented by the general formula (1), an electrophotographic photoreceptor that does not deteriorate the electrical characteristics such as the charging property, the sensitivity and the responsiveness, and is excellent in the oxidizing gas resistance such as the ozone resistance and the nitrogen oxide resistance can be realized. The reason why excellent oxidizing gas resistance can be imparted to the photoreceptor when the amine compound represented by the general formula (1) is contained in the photosensitive layer is assumed that the amine compound represented by the general formula (1) captures the oxidizing gases such as ozone, nitrogen oxides, chlorine oxides and sulfur oxide and thereby inhibits an ion pair generation reaction from occurring between the oxidizing gases and the charge transport material, which accompanies an electron transfer, and absorption of the oxidizing gases by the charge generation material from occurring. Accordingly, it is considered that, in the photoreceptor according to the invention, the fatigue and deterioration are suppressed, and, even though the photoreceptor is repeatedly used, a decrease in the charging potential, an increase in the rest potential, the deterioration of the sensitivity, and the deterioration of the resolution power due to a decrease in the surface resistance are not caused.

Accordingly, as mentioned above, when the amine compound represented by the general formula (1) is contained in the photosensitive layer, an electrophotographic photoreceptor that is excellent in the electrical characteristics such as the charging property, the sensitivity and the responsiveness, the oxidizing gas resistance such as the ozone resistance and the nitrogen oxide resistance, and the electrical durability that even after repeated use the foregoing excellent electrical characteristics are not deteriorated can be obtained.

According to the invention, among the amine compounds represented by the general formula (1), the foregoing particular amine compounds are preferable. The particular amine compounds are particularly effective in suppressing the fatigue and deterioration of the photoreceptor.

Furthermore, according to the invention, at least one of the charge generation layer and the charge transport layer that constitute the photosensitive layer preferably includes the amine compound represented by the general formula (1). Thus, when at least one of the charge generation layer and the charge transport layer includes the amine compound represented by the general formula (1), an ion pair generation reaction between the oxidizing gases and the charge transport material, which accompanies an electron transfer, and/or absorption of the oxidizing gases by the charge generation material can be effectively suppressed from occurring; accordingly, the oxidizing gas resistance such as the ozone resistance and the nitrogen oxide resistance of the photoreceptor can be improved. Furthermore, when the charge generation layer and the charge transport layer are disposed to the photosensitive layer and thereby a charge generation function and a charge transport function are carried out separately, materials that constitute individual layers can be independently selected. Accordingly, since materials best for each of the charge generation function and the charge transport function can be selected, the electrical characteristics such as the charging property, the sensitivity and the responsiveness of the photoreceptor can be improved. As a result, an electrophotographic photoreceptor that has particularly excellent electrical characteristics and is improved in the stability of the electrical characteristics during repeated use of the photoreceptor can be obtained.

Still furthermore, according to the invention, an amine compound represented by the general formula (1) is preferably contained at a ratio of 1 part by weight or more and 20 parts by weight or less to 100 parts by weight of a charge transport material. Thereby, an electrophotographic photoreceptor that is particularly excellent in the electrical characteristics such as the charging property, the sensitivity and the responsiveness, and the oxidizing gas resistance can be realized. When an amount of the amine compound that is represented by the general formula (1) and used is less than 1 part by weight to 100 parts by weight of the charge transport material, the resisting property to the oxidizing gas such as ozone and nitrogen oxides cannot be obtained sufficiently, and, during repeated use of the photoreceptor, a decrease in the charging potential and a decrease in the sensitivity may occur. Furthermore, when an amount of the amine compound that is represented by the general formula (1) and used exceeds 20 parts by weight to 100 parts by weight of the charge transport material, the sensitivity and the responsiveness are deteriorated, and the rest potential may go up when the photoreceptor is repeatedly used.

According to the invention, in an electrophotographic photoreceptor of image forming apparatus, an electrophotographic photoreceptor according to the invention, which is excellent in the electrical characteristics such as the charging property, the sensitivity and the responsiveness, the oxidizing gas resistance, and the electrical durability that even after repeated use of the photoreceptor the excellent electrical characteristics do not deteriorate can be used. Thereby, an image forming apparatus that can form a high quality image stably over a long period and is high in the reliability can be realized.

BRIEF DESCRIPTION OF THE DRAWINGS

Other and further objects, features, and advantages of the invention will be more explicit from the following detailed description taken with reference to the drawings wherein.

DETAILED DESCRIPTION

Figure 1:
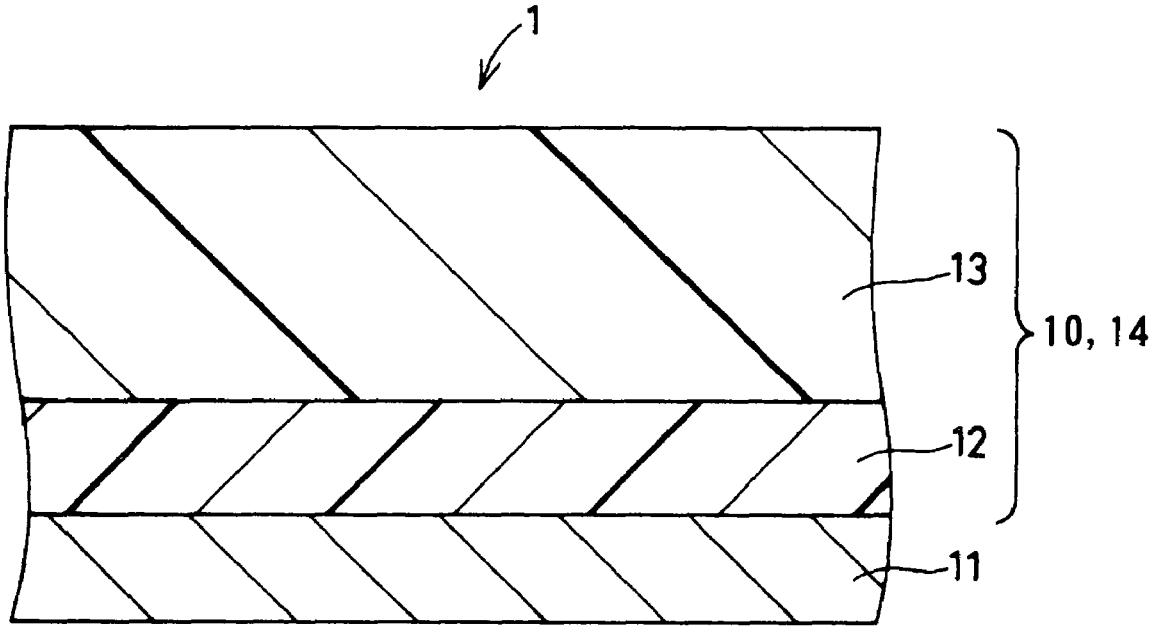
FIG. 1 is a partial sectional view showing in a simplified manner a configuration of an electrophotographic photoreceptor that is a first embodiment according to the invention.

Now referring to the drawings, preferred embodiments of the invention are described below.

FIG. 1 is a partial sectional view showing in a simplified manner a configuration of an electrophotographic photoreceptor 1 that is a first embodiment according to the invention. The electrophotographic photoreceptor 1 includes a sheet-like electrically conductive substrate 11 made of an electrically conductive material, a charge generation layer 12 that is a layer laminated on the electrically conductive layer 11 and contains a charge generation material, and a charge transport layer 13 that is a layer further laminated on the charge generation layer 12 and contains a charge transport material. The charge generation layer 12 and the charge transport layer 13 constitute a laminate photoconductive layer 14 that is a photosensitive layer 10. That is, the photoreceptor 1 is a laminate photoreceptor.

The electrically conductive substrate 11 plays a role as an electrode of the photoreceptor 1 and also functions as a support member of other respective layers 12 and 13. A shape of the electrically conductive substrate 11, though sheet-like in the embodiment, is not restricted thereto and may be cylindrical, circular cylinder-like or endless belt-like.

As the electrically conductive material that constitutes the electrically conductive substrate 11, a metal simple body such as aluminum, copper, zinc and titanium, and an alloy such as an aluminum alloy and stainless steel can be used. Furthermore, without restricting to the metal materials, ones in which, on a surface of a polymer such as polyethylene terephthalate, nylon or polystyrene, hard paper or glass, a metal foil is laminated, a metal is deposited or a layer of an electrically conductive compound such as an electrically conductive polymer, tin oxide or indium oxide is deposited or coated can be used. The electrically conductive materials are cut into a predetermined size and used.

On a surface of the electrically conductive substrate 11, as needs arise, within a range that does not adversely affect on the image quality, an anodic oxide film process, a surface treatment with a chemical or hot water, a coloring process, or a diffused reflection process such as surface roughening may be applied. In an electrophotography process in which a laser is used as an exposure light source, since a wavelength of a laser light is homogeneous, in some cases, laser light reflected on a surface of the photoreceptor and laser light reflected inside of the photoreceptor interfere each other and interference fringes due to the interference appear on an image, resulting in causing an image defect. When a surface of the electrically conductive substrate 11 is processed as mentioned above, an image defect due to the interference of the laser light homogeneous in the wavelength can be inhibited from occurring.

The photosensitive layer 10 disposed on the electrically conductive substrate 11 contains an amine compound represented by the following general formula (1) in at least one of the charge generation layer 12 and the charge transport layer 13.

(1)

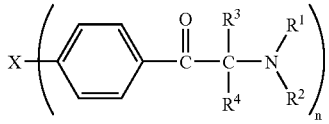

In the general formula (1), signs $R^1$ and $R^2$ may be same or different each other and, respectively, denote an alkyl group that may have a substituent group, a cycloalkyl group that may have a substituent group, a heterocycloalkyl group that may have a substituent or an aralkyl group that may have a substituent group. In the invention, the heterocycloalkyl group means a monovalent group that can be obtained by removing one hydrogen atom that binds to a carbon atom from a cycloalkane having a heteroatom between carbon atoms.

In the general formula (1), the alkyl groups represented by signs $R^1$ and $R^2$ include a straight chain alkyl group such as a methyl group, an ethyl group, a n-propyl group, a n-butyl group and a n-hexyl group; and a branched chain alkyl group such as an isopropyl group, a t-butyl group and a neopentyl group. Among these, an alkyl group having 1 to 4 carbon atoms is preferable. As a substituent group that the alkyl groups represented by signs $R^1$ and $R^2$ can have, an alkoxy group such as a methoxy group, an ethoxy group and a propoxy group, preferably an alkoxy group having 1 to 4 carbon atoms, and a halogen atom such as a fluorine atom, a chlorine atom and a bromine atom can be cited.

In the general formula (1), as the cycloalkyl group represented by signs $R^1$ and $R^2$, a cyclopentyl group, a cyclohexyl group, and a cycloheptyl group can be cited. Among these, a cycloalkyl group having 4 or 5 carbon atoms is preferable. As a substituent group that the cycloalkyl group represented by signs $R^1$ and $R^2$ can have, an alkoxy group such as a methoxy group, an ethoxy group and a propoxy group, preferably an alkoxy group having 1 to 4 carbon atoms, and a halogen atom such as a fluorine atom, a chlorine atom and a bromine atom can be cited.

In the general formula (1), as the heterocycloalkyl groups represented by signs $R^1$ and $R^2$, a heterocycloalkyl group such as a pyrrolidinyl group, a piperidyl group, a tetrahydrofuryl group, a tetrahydropyranyl group, an imidazolydinyl group or a morpholinyl group that has 2 to 6 carbon atoms, preferably 4 or 5 carbon atoms and as a heteroatom an oxygen atom, a nitrogen atom, a sulfur atom, selenium atom or tellurium atom, preferably an oxygen atom, a nitrogen atom or a sulfur atom can be cited. As a substituent group that the heterocycloalkyl group represented by signs $R^1$ and $R^2$ can have, an alkoxy group such as a methoxy group, an ethoxy group and a propoxy group, preferably an alkoxy group having 1 to 4 carbon atoms, and a halogen atom such as a fluorine atom, a chlorine atom and a bromine atom can be cited.

In the general formula (1), as the aralkyl groups represented by signs $R^1$ and $R^2$, a phenylalkyl group such as a benzil group and a phenethyl group; and a naphthylalkyl group such as a 1-naphthylmethyl group and a 2-(1-naphthyl) ethyl group can be cited. Among these, the phenylalkyl group is preferable and a phenylalkyl group having 7 to 9 carbon atoms is more preferable. As a substituent group that the aralkyl groups represented by signs $R^1$ and $R^2$ can have, an alkyl group such as a methyl group, an ethyl group and a propyl group, preferably an alkyl group having 1 to 4 carbon atoms, an alkoxy group such as a methoxy group, an ethoxy group and a propoxy group, preferably an alkoxy group having 1 to 4 carbon atoms, and a halogen atom such as a fluorine atom, a chlorine atom and a bromine atom can be cited.

In the general formula (1), signs $R^3$ and $R^4$ may be same or different from each other, and, respectively, denote an alkyl group that may have an alkoxycarbonyl group as a substituent group or an aralkyl group that may have a substituent group.

In the general formula (1), as the alkyl groups represented by signs $R^3$ and $R^4$, a straight chain alkyl group such as a methyl group, an ethyl group, a n-propyl group, a n-butyl group and a n-hexyl group and a branched chain alkyl group such as an isopropyl group, a t-butyl group and a neopentyl group can be cited. Among these, an alkyl group having 1 to 8 carbon atoms is preferable, and an alkyl group having 1 to 4 carbon atoms is more preferable.

In the general formula (1), as the alkoxycarbonyl group that the alkyl groups represented by signs $R^3$ and $R^4$ may have as a substituent group, a straight chain alkoxycarbonyl group such as a methoxycarbonyl group, an ethoxycarbonyl group, a n-propoxycarbonyl group and a n-hexanoxycarbonyl group; and a branched-chain alkoxycarbonyl group such as an isopropoxycarbonyl group and a 4,4-dimethylbuthoxycarbonyl group can be cited. Among these, the alkoxycarbonyl group having 2 to 5 carbon atoms is preferable. As the alkyl groups that are represented by signs $R^3$ and $R^4$ and have an alkoxycarbonyl group as a substituent, an alkoxycarbonylalkyl group such as a methoxycarbonylmethyl group, an ethoxycarbonylmethyl group and a 2-methoxycarbonylethyl group can be cited. Among these, an alkyl group that has an alkoxycarbonyl group having 2 to 5 carbon atoms as a substituent group and 1 to 8 carbon atoms, preferably 1 to 4 carbon atoms is preferable.

In the general formula (1), alkyl groups represented by signs $R^3$ and $R^4$ may have another substituent group other than an alkoxycarbonyl group. As the another substituent group other than the alkoxycarbonyl group, which the alkyl groups represented by signs $R^3$ and $R^4$ in the general formula (1) may have, an alkoxy group such as a methoxy group, an ethoxy group and a propoxy group, preferably an alkoxy group having 1 to 4 carbon atoms, and a halogen atom such as a fluorine atom, a chlorine atom and a bromine atom can be cited.

In the general formula (1), as aralkyl groups represented by signs $R^3$ and $R^4$, a phenylalkyl group such as a benzil group and a phenethyl group and a naphthylalkyl group such as 1-naphthylmethyl group and a 2-(1-naphthyl)ethyl group can be cited. Among these, the phenylalkyl group is preferable and a phenylalkyl group having 7 to 9 carbon atoms is more preferable. As a substituent group that the aralkyl groups represented by signs $R^3$ and $R^4$ can have, an alkyl group such as a methyl group, an ethyl group and a propyl group, preferably an alkyl group having 1 to 4 carbon atoms, an alkoxy group such as a methoxy group, an ethoxy group and a propoxy group, preferably an alkoxy group having 1 to 4 carbon atoms, and a halogen atom such as a fluorine atom, a chlorine atom and a bromine atom can be cited.

In the general formula (1), a sign n denotes an integer 1 or 2.

In the general formula (1), a sign X, when n is 1, denotes a hydrogen atom, a halogen atom, a hydroxyl group (—OH), an alkyl group, an alkoxy group, an alkylthio group, an alkylsulfonyl group, a phenylthio group (—$SC_6H_5$), a phenoxy group (—$OC_6H_5$), or a substituted amino group represented by —$NR^5R^6$ ($R^5$ and $R^6$ may be same or different from each other, and, respectively, represent an alkyl group that may have an alkoxy group as a substituent group, an aryl group, or an alkylene group that, when couples each other, may have an oxygen atom, an imino group or a N-alkylimino group between carbon atoms); and, X, when n is 2, represents —O—, —S— or an alkylene group.

In the general formula (1), as a halogen atom represented by the sign X, a fluorine atom, a chlorine atom and a bromine atom can be cited, and among these, a fluorine atom and a chlorine atom are preferable.

In the general formula (1), as the alkyl group represented by the sign X, a straight chain alkyl group such as a methyl group, an ethyl group, a n-propyl group, a n-butyl group and a n-hexyl group and a branched chain alkyl group such as an isopropyl group, a t-butyl group and a neopentyl group can be cited. Among these, an alkyl group having 1 to 4 carbon atoms is preferable.

In the general formula (1), as the alkoxy group represented by the sign X, a straight chain alkoxy group such as a methoxy group, an ethoxy group, a n-propoxy group and a n-hexanoxy group; and a branched chain alkoxy group such as an isopropoxy group and an isohexanoxy group can be cited. Among these, an alkoxy group having 1 to 4 carbon atoms is preferable.

In the general formula (1), as the alkylthio group represented by the sign X, a straight chain alkylthio group such as a methylthio group (—$SCH_3$), an ethylthio group, a n-propylthio group, a n-butylthio group and a n-hexylthio group; and a branched chain alkylthio group such as an isopropylthio group, a t-butylthio group and a neopentyl group can be cited. Among these, an alkylthio group having 1 to 4 carbon atoms is preferable.

In the general formula (1), as the alkylsulfonyl group represented by the sign X, a straight chain alkylsulfonyl group such as a methylsulfonyl group (—$SO_2CH_3$), an ethylsulfonyl group, a n-propylsulfonyl group, a n-butylsulfonyl group and a n-hexylsulfonyl group; and a branched chain alkylsulfonyl group such as an isopropylsulfonyl group, a t-butylsulfonyl group and a neopentylsulfonyl group can be cited. Among these, an alklsulfonyl group having 1 to 4 carbon atoms is preferable.

In the general formula (1), the alkyl group, alkoxy group, alkylthio group and alkylsulfonyl group represented by the sign X, respectively, may have a substituent group. As a substituent group that the alkyl group, alkoxy group, alkylthio group and alkylsulfonyl group represented by the sign X can have, an alkoxy group such as a methoxy group, an ethoxy group and a propoxy group, preferably an alkoxy group having 1 to 4 carbon atoms, and a halogen atom such as a fluorine atom, a chlorine atom and a bromine atom can be cited.

In the general formula (1), the phenylthio group and phenoxy group represented by the sign X, respectively, may have a substituent group as well. As a substituent group that the phenylthio group and phenoxy group represented by the sign X may have, an alkyl group such as a methyl group, an ethyl group and a propyl group, preferably an alkyl group having 1 to 4 carbon atoms; an alkoxy group such as a methoxy group, an ethoxy group, and a propoxy group, preferably an alkoxy group having 1 to 4 carbon atoms; and a halogen atom such as a fluorine atom, a chlorine atom and a bromine atom can be cited.

When, in the general formula (1), the sign X denotes a substituted amino group represented by —$NR^5R^6$, as alkyl groups represented by signs $R^5$ and $R^6$ in —$NR^5R^6$, a straight chain alkyl group such as a methyl group, an ethyl group, a n-propyl group, a n-butyl group and a n-hexyl group; and a branched chain alkyl group such as an isopropyl group, a t-butyl group and a neopentyl group can be cited. Among these, an alkyl group having 1 to 12 carbon atoms is preferable, and an alkyl group having 1 to 4 carbon atoms is more preferable.

As an alkoxy group that alkyl groups represented by signs $R^5$ and $R^6$ in —$NR^5R^6$ may have as a substituent group, a straight chain alkoxy group such as a methoxy group, an ethoxy group, a n-propoxy group and a n-hexanoxy group; and a branched chain alkoxy group such as an isopropoxy group and an isohexanoxy group can be cited. Among these, an alkoxy group having 1 to 4 carbon atoms is preferable. As an alkyl group that is represented by signs $R^5$ and $R^6$ and has an alkoxy group as a substituent group, an alkoxyalkyl group such as a methoxymethyl group, an ethoxymethyl group, a 2-methoxyethyl group, a 2-propoxyethyl group and a methoxypropyl group can be cited. Among these, an alkyl group that has 2 to 4 carbon atoms and an alkoxy group having 1 to 4 carbon atoms as a substituent group is preferable.

Alkyl groups represented by signs $R^5$ and $R^6$ in —$NR^5R^6$ may have another substituent group in addition to the alkoxy group. As a substituent group other than the alkoxy group that the alkyl groups represented by signs $R^5$ and $R^6$ in —$NR^5R^6$ may have, a halogen atom such as a fluorine atom, a chlorine atom and a bromine atom can be cited.

Aryl groups represented by signs $R^5$ and $R^6$ in —$NR^5R^6$ may have a substituent group. As a substituent group that the aryl groups represented by signs $R^5$ and $R^6$ may have, an alkyl group such as a methyl group, an ethyl group and a propyl group, preferably an alkyl group having 1 to 4 carbon atoms; an alkoxy group such as a methoxy group, an ethoxy group, and a propoxy group, preferably an alkoxy group having 1 to 4 carbon atoms; and a halogen atom such as a fluorine atom, a chlorine atom and a bromine atom can be cited.

As an alkylene group that signs $R^5$ and $R^6$ couple each other in —$NR^5R^6$ to show, a pentamethylene group, a hexamethylene group and a heptamethylene group can be cited. Among these, an alkylene group having 4 to 8 carbon atoms is preferable and an alkylene group having 4 or 5 carbon atoms is more preferable. An alkylene group that is shown when signs $R^5$ and $R^6$ couple each other may have a substituent group. As a substituent group that an alkylene group that is shown when signs $R^5$ and $R^6$ couple each other can have, an alkoxy group such as a methoxy group, an ethoxy group, and a propoxy group, preferably an alkoxy group having 1 to 4 carbon atoms; and a halogen atom such as a fluorine atom, a chlorine atom and a bromine atom can be cited.

As a N-alkylimino group that an alkylene group that signs $R^5$ and $R^6$ couple each other in —$NR^5R^6$ to show may have between carbon atoms, a straight chain N-alkylimino group such as a N-methylimino group, a N-ethylimino group, a N-(n-propyl) imino group, a N-(n-butyl) imino group and a N-(n-hexyl) imino group; and a branched chain N-alkylimino group such as a N-isopropylimino group, a N-(t-butyl)imino group and a N-neopentylimino group can be cited. Among these, a N-alkylimino group having 1 to 4 carbon atoms is preferable.

As an alkylene group that is shown when signs $R^5$ and $R^6$ couple each other in —$NR^5R^6$ and has an oxygen atom, an imino group or a N-alkylimino group between carbon atoms, an oxydiethylene group (—$CH_2$—$CH_2$—O—$CH_2$—$CH_2$—) and a thiodiethylene group (—$CH_2$—$CH_2$—S—$CH_2$—$CH_2$—) can be cited. Among these, an alkylene group that has 4 to 8 carbon atoms, preferably 4 or 5 carbon atoms and has, between carbon atoms, an oxygen atom, an imino group or a N-alkylimino group, preferably an oxygen atom, an imino group or a N-alkylimino group having 1 to 4 carbon atoms is preferable.

In the general formula (1), as a substituted amino group (—$NR^5R^6$) represented by the sign X, a dialkylamino group such as a symmetrical dialkylamino group such as a dimethylamino group, a diethylamino group and a diisopropylamino group; and a non-symmetrical dialkylamino group such as an ethylmethylamino group and an isopropylethylamino group; a pyrrolidino group; and a piperidino group can be cited.

In the general formula (1), as an alkylene group represented by the sign X, a methylene group (—$CH_2$—), an ethylene group, a trimethylene group and a hexamethylene group can be cited. Among these, an alkylene group having 1 to 4 carbon atoms is preferable. An alkylene group represented by the sign X may have a substituent group. As a substituent group that an alkylene group represented by the sign X may have, an alkoxy group such as a methoxy group, an ethoxy group and a propoxy group, preferably an alkoxy group having 1 to 4 carbon atoms; and a halogen atom such as a fluorine atom, a chlorine atom and a bromine atom can be cited.

Like in the embodiment, when an amine compound represented by the general formula (1) is contained in the photosensitive layer 10, the oxidizing gas resistance such as the ozone resistance and the nitrogen oxide resistance can be imparted to the photoreceptor 1. This is assumed that the amine compound represented by the general formula (1) captures the oxidizing gases such as ozone, nitrogen oxides, chlorine oxides and sulfur oxides and thereby inhibits an ion pair generation reaction between the oxidizing gases and a charge transport material contained in the charge transport layer 13, which accompanies an electron transfer, and/or absorption of the oxidizing gases by the charge generation material contained in the charge generation layer 12 from occurring. Accordingly, it is considered that, in the photoreceptor 1, the fatigue and deterioration are suppressed, and, even after repeated use thereof, a decrease in the charging potential, an increase in the rest potential, the deterioration of the sensitivity, and the deterioration of the resolution power due to a decrease in the surface resistance are not caused.

Furthermore, when an amine compound represented by the general formula (1) is added in the photosensitive layer 10, the electrical characteristics such as the charging property, the sensitivity and the responsiveness of the photoreceptor 1 are not deteriorated. That is, in the embodiment, without deteriorating the electrical characteristics such as the charging property, the sensitivity and the responsiveness, the oxidizing gas resistance such as the ozone resistance and the nitrogen oxide resistance can be imparted to the photoreceptor 1.

Accordingly, when an amine compound represented by the general formula (1) is included in the photosensitive layer 10, a photoreceptor 1 that is excellent in the electrical characteristics such as the charging property, the sensitivity and the responsiveness, the oxidizing gas resistance such as the ozone resistance and the nitrogen oxide resistance, and the electrical durability that even after repeated use thereof the foregoing excellent electrical characteristics are not deteriorated can be realized.

Among amine compounds represented by the general formula (1), as a compound particularly excellent from a viewpoint of suppressing the fatigue and deterioration of the photoreceptor 1, one where, in the general formula (1), $R^3$ and $R^4$, respectively, represent an alkyl group that has 1 to 8 carbon atoms and may have an alkoxycarbonyl group having 2 to 5 carbon atoms as a substituent group, or a phenylalkyl group having 7 to 9 carbon atoms; and

X, when n is 1, represents a hydrogen atom, a halogen atom, a hydroxyl group, an alkyl group having 1 to 4 carbon atoms, an alkoxy group having 1 to 4 carbon atoms, an alkylthio group having 1 to 4 carbon atoms, an alkylsulfonyl group having 1 to 4 carbon atoms, a phenylthio group, a phenoxy group, or a substituted amino group represented by $—NR^{5a}R^{6a}$ ($R^{5a}$ and $R^{6a}$, respectively, represent an alkyl group having 1 to 12 carbon atoms, an alkyl group that has 2 to 4 carbon atoms and an alkoxy group having 1 to 4 carbon atoms as a substituent group, an aryl group, or an alkylene group that has 4 to 5 carbon atoms and, when couples each other, may have an oxygen atom, an imino group or a N-alkylimino group having 1 to 4 carbon atoms between carbon atoms); and, when n is 2, represents —O—, —S— or an alkylene group having 1 to 4 carbon atoms can be cited.

Among these, an amine compound in which, in the general formula (1), $R^1$ and $R^2$, respectively, represent an alkyl group having 1 to 4 carbon atoms;

$R^3$ and $R^4$, respectively, represent an alkyl group that has 1 to 8 carbon atoms and may have an alkoxycarbonyl group having 2 to 5 carbon atoms as a substituent group, or an alkylphenyl group having 7 to 9 carbon atoms;

n is 1; and

X represents a hydrogen atom or an alkylene group that has 4 to 5 carbon atoms and, when $R^5$ and $R^6$ couple each other in $—NR^5R^6$, has an oxygen atom between carbon atoms is particularly preferable.

An amine compound represented by the general formula (1) is known and disclosed in, for instance, Japanese Examined Patent Publication JP-B2 62-9124 (1987) and Japanese Examined Patent Publication JP-B2 01-34242 (1989).

An amine compound represented by the general formula (1) can be manufactured in such a manner that, for instance, a ketone compound represented by a general formula (1a) below (1a)

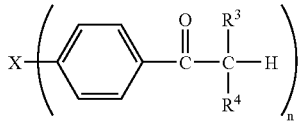

(In the formula, $R^3$, $R^4$, X and n are same as that defined in the general formula (1).) is halogenated, an obtained halogenated ketone compound represented by a general formula (1b) below (1b)

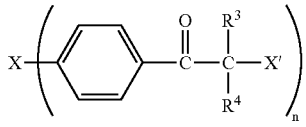

(In the formula, X' denotes a halogen atom, and $R^3$, $R^4$, X and n are same as that defined in the general formula (1).) is epoxidated, an obtained epoxide intermediate represented by a general formula (1c) below (1c)

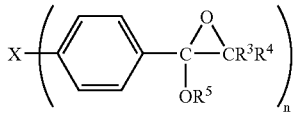

(In the formula, $R^5$ denotes an alkyl group, and $R^3$, $R^4$, X and n are same as that defined in the general formula (1).) and an amine compound represented by a general formula (1d) below $$HNR^1R^2 \quad (1d)$$

(In the formula, $R^1$ and $R^2$ are same as that defined in the general formula (1).) are allowed to react.

A ketone compound represented by the general formula (1a) can be halogenated, for instance, as follows. A ketone compound represented by the general formula (1a) is dissolved in an inactive solvent such as tetrachloromethane, while maintaining this solution at a temperature in the range of 40 to 80° C., a stoichiometric amount of halogen such as chlorine ($Cl_2$) or bromine ($Br_2$) is added. In an obtained reaction mixture, nitrogen is introduced to remove halogenated hydrogen such as hydrogen chloride (HCl) or hydrogen bromide (HBr) that is a reaction byproduct, followed by distilling the solvent. Thereby, the halogenated ketone compound represented by the general formula (1b) can be obtained.

A halogenated ketone compound represented by the general formula (1b) can be epoxidated, for instance, as shown below. A halogenated ketone compound represented by the general formula (1b) is dissolved in a solvent such as methanol and this solution is dropped at a reflux temperature in a solution in which a stoichiometric amount of metal alkoxide is dissolved in a solvent such as methanol. As the metal alkoxide, a salt of an alkali metal such as sodium or potassium of alcohol having 1 to 4 carbon atoms such as sodium methoxide can be preferably used. After the reaction comes to completion, the solvent is distilled, as needs arise, purified, and thereby an epoxide intermediate represented by the general formula (1c) is obtained. In the general formula (1c), an alkyl group represented by a sign $R^5$ corresponds to an alkyl group of a metal alkoxide.

A reaction between the epoxide intermediate represented by the general formula (1c) and the amine compound represented by the general formula (1d) is carried out, for instance, as shown below. The epoxide intermediate represented by the general formula (1c) is cross-linked by a stoichiometric amount of amine compound represented by the general formula (1d) without a solvent or under presence of a slight amount of solvent such as toluene or xylene, followed by reacting at a temperature in the range of 100 to 200° C. for substantially 10 to 20 hrs. The reaction is carried out under pressure, for instance, in an autoclave, when the amine compound represented by the general formula (1d) is a low boiling point amine compound such as dimethylamine or diethylamine where, in the general formula (1d), $R^1$ and $R^2$ are groups having 1 to 4 carbon atoms. A reaction mixture is diluted with benzene or the like, extracted with a dilute acid such as dilute hydrochloric acid, an obtained aqueous acid solution is rendered alkaline with a base such as sodium hydroxide, followed by extracting with ether, further followed by distilling a solvent after washing with water, as needs arise, still further followed by purifying. Thereby, an amine compound represented by the general formula (1) is obtained.

Furthermore, an amine compound represented by the general formula (1) can be manufactured also by reacting a halogenated ketone compound represented by the general formula (1b) and an amine compound represented by the general formula (1d). In this case, a halogenated ketone compound represented by the general formula (1b) is, as needs arise, diluted with a solvent such as toluene, followed by mixing with two mole equivalent of an amine compound represented by the general formula (1d), further followed by allowing reacting at a temperature in the range of 100 to 200° C. for 10 to 20 hrs. This reaction as well is carried out under pressure or in an autoclave when the amine compound represented by the general formula (1d) is a low boiling point amine compound such as dimethylamine or diethylamine where, in the general formula (1d), $R^1$ and $R^2$ are groups having 1 to 4 carbon atoms. The reaction mixture is similarly processed as the reaction mixture obtained according to a reaction between the epoxide intermediate and the general formula (1d), as needs arise, followed by purifying, and thereby an amine compound represented by the general formula (1) is obtained.

As a specific example of an amine compound represented by the general formula (1), for instance, exemplification compounds No. 1 through No. 22 shown in Tables 1 through 4 below can be cited. However, amine compounds represented by the general formula (1) are not restricted thereto.

TABLE 1

| Exemplification compound No. | Structural formula |
|---|---|
| 1 | 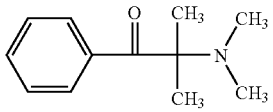 |
| 2 | 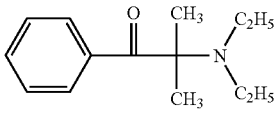 |
| 3 | 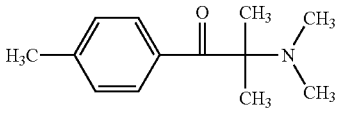 |
| 4 | 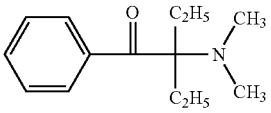 |
| 5 | 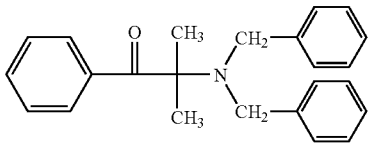 |

TABLE 1-continued

| Exemplification compound No. | Structural formula |
|---|---|
| 6 | 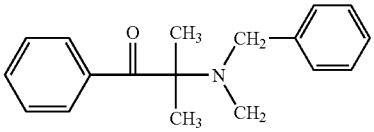 |
| 7 | 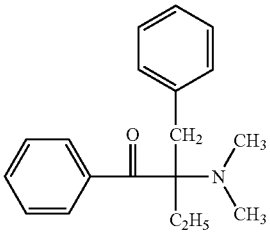 |

TABLE 2

| Exemplification compound No. | Structural formula |
|---|---|
| 8 | 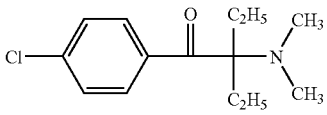 |
| 9 | 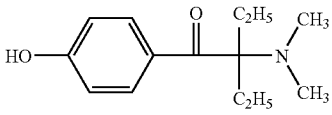 |
| 10 | 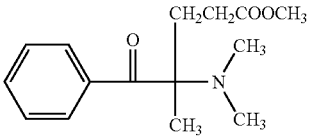 |
| 11 | 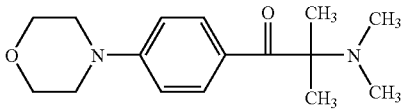 |
| 12 | 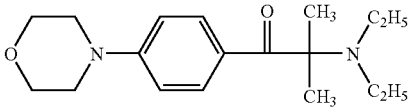 |
| 13 | 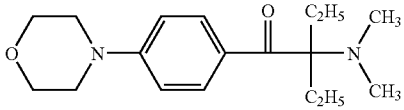 |

TABLE 2-continued
| Exemplification compound No. | Structural formula |
|---|---|
| 14 | 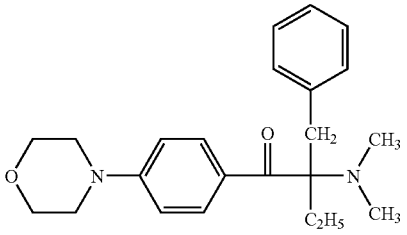 |
TABLE 3
| Exemplification compound No. | Structural formula |
|---|---|
| 15 | 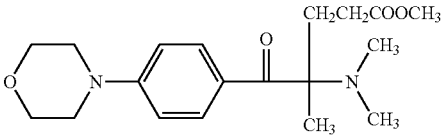 |
| 16 | 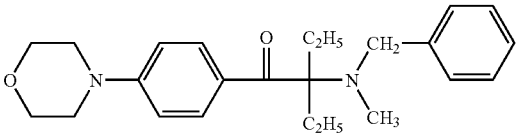 |
| 17 | 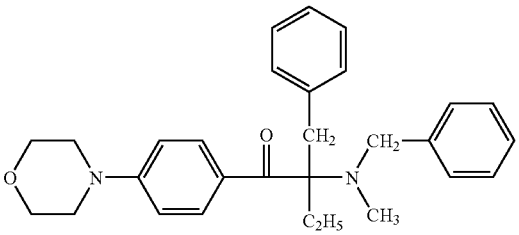 |
| 18 | 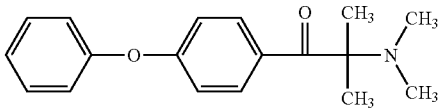 |
| 19 | 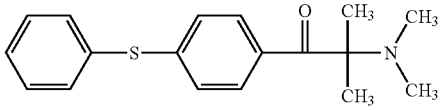 |
| 20 | 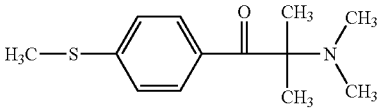 |

TABLE 4

| Exemplification compound No. | Structural formula |
|---|---|
| 21 | 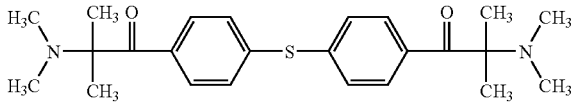 |
| 22 | 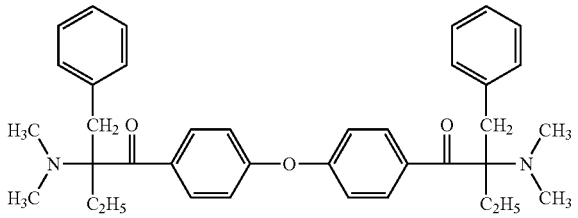 |

As an amine compound represented by the general formula (1), one kind selected from the exemplification compounds shown in, for instance, the Tables 1 through 4 may be singularly used, or two or more kinds thereof may be used in combination.

The amine compound represented by the general formula (1) may be contained in any one of the charge generation layer 12 and the charge transport layer 13, or may be contained in both the charge generation layer 12 and the charge transport layer 13. In particular, in the charge transport layer 13, the amine compound represented by the general formula (1) is preferably added.

The amine compound represented by the general formula (1) is preferably added in the range of 1 part by weight or more and 20 parts by weight or less to 100 parts by weight of the charge transport material. When the amine compound represented by the general formula (1) is added in particular to the charge transport layer 13, the amine compound represented by the general formula (1) is preferably contained in the charge transport layer 13 at a ratio of 1 part by weight or more and 20 parts by weight or less to 100 parts by weight of the charge transport material contained in the charge transport layer 13. Thereby, an electrophotographic photoreceptor that is particularly excellent in the electrical characteristics such as the charging property, the sensitivity and the responsiveness and the oxidizing gas resistance can be realized. When the amine compound represented by the general formula (1) is contained in the photosensitive layer 10, in particular, in the charge transport layer 13 at a ratio less than 1 part by weight to 100 parts by weight of the charge transport material, the resistance to the oxidizing gases such as ozone, nitrogen oxides or the like cannot be sufficiently obtained, and when the photoreceptor is repeatedly used a decrease in the charging potential and the sensitivity may be caused. Furthermore, when the amine compound represented by the general formula (1) is contained in the photoreceptor layer 10, in particular, in the charge transport layer 13 at a ratio exceeding 20 parts by weight to 100 parts by weight of the charge transport material, the sensitivity and the responsiveness deteriorate, and when the photoreceptor is repeatedly used the rest potential may go up.

The photosensitive layer 10 is, as mentioned above, constituted of a laminate photoconductive layer 14 that is formed by laminating a charge generation layer 12 that contains the charge generation material and a charge transport layer 13 that contains the charge transport material. When the charge generation function and the charge transfer function are carried out thus by separate layers, since a material that constitutes each of the layers 12 and 13 can be independently selected, the best material can be selected for each of the charge generation function and the charge transfer function. Accordingly, the photoreceptor 1 according to the embodiment is particularly excellent in the electrical characteristics such as the charging property, the sensitivity and the photoresponsiveness, and in the stability, that is, the electrical durability of the electrical characteristics when the photoreceptor is repeatedly used.

The charge generation layer 12 that constitutes the photosensitive layer 10 contains a charge generation material that generates electric charges upon absorption of light, and as needs arise further contains the amine compound represented by the general formula (1). Materials effective as the charge generation material include an azo base pigment such as a monoazo base pigment, a bisazo base pigment and a triazo base pigment; an indigo base pigment such as indigo and thioindigo; a perylene base pigment such as perylene imide and perylene acid anhydride; a polycyclic quinone base pigment such as anthraquinone and pyrene quinone; a phthalocyanine base pigment such as metal phthalocyanine such as oxotitanium phthalocyanine and metal-free phthalocyanine; an organic photoconductive material such as a squarilium dye, a pyrylium salt and a thiopyrylium salt, and a triphenyl methane base dye; and an inorganic photoconductive material such as selenium and amorphous silicon.

Among the charge generation materials, oxotitanium phthalocyanine can be preferably used. The oxotitanium phthalocyanine is excellent in the charge generating capability and the charge injecting capability; accordingly, upon absorption of light, electric charges are generated a lot and, without accumulating generated electric charges therein, can be efficiently injected to the charge transport material contained in the charge transport layer 13. Accordingly, when the oxotitanium phthalocyanine is used as the charge generation material, a photoreceptor 1 particularly excellent in the sensitivity and the resolution power can be realized. In the oxotitanium phthalocyanine, a hydrogen atom of a benzene ring that is contained in a phthalocyanine group may be substituted with a halogen atom such as a chlorine atom or a fluorine atom, or a substituent group such as a nitro group, a cyano group or a sulfo group, or a ligand may be coordinated to a central metal.

The charge generation materials may be used singularly or in a combination of at least two kinds.

The charge generation material may be used in combination with a sensitizing dye such as a triphenyl methane base dye typical in methyl violet, crystal violet, night blue and victoria blue; an acrydine dye typical in erythrosine, rhodamine B, rhodamine 3R, acrydine orange and flapeosine; a thiazine dye typical in methylene blue and methylene green; an oxazine dye typical in capri blue and meldola blue; a cyanine dye; a styryl dye; a pyrylium salt dye or a thiopyrylium salt dye.

The charge generation layer 12 may include a binder resin to improve the binding property. As a binder resin that is used in the charge generation layer 12, resins such as a polyester resin, a polystyrene resin, a polyurethane resin, a phenolic resin, an alkyd resin, a melamine resin, an epoxy resin, a silicone resin, an acryl resin, a methacryl resin, a polycarbonate resin, a polyarylate resin, a phenoxy resin, a polyvinyl butyral resin and a polyvinyl formal resin; and copolymer resins including at least two repetition units that form the foregoing resins can be cited. Specific examples of the copolymers include insulating resins such as a vinyl chloride-vinyl acetate copolymer resin, a vinyl chloride-vinyl acetate-maleic acid anhydride copolymer resin and an acrylonitrile-styrene copolymer resin. The binder resin is not restricted thereto and resins generally used in this field can be used as a binder resin. The binder resin may be used singularly or in a combination of at least two kinds.

In the charge generation layer 12 that is constituted including a charge generation material and a binder resin, a ratio of a weight W1 of the charge generation material and a weight W2 of the binder resin, W1/W2, is preferably 10/100 or more and 99/100 or less. When the ratio W1/W2 is less than 10/100, the sensitivity of the photoreceptor 1 may deteriorate. When the ratio W1/W2 exceeds 99/100, the film strength of the charge generation layer 12 may be deteriorated. Furthermore, since the dispersing property of the charge generation material deteriorates to increase an amount of coarse particles and surface charge in a portion other than a portion that has to be erased decreases owing to exposure, image defect, in particular, image fogging called black spots where a toner sticks to a white background to form small black spots may increase.

As a method of forming the charge generation layer 12, a method of vacuum depositing the charge generation material on a surface of a electrically conductive substrate 11, and a method in which the charge generation material and as needs arise the binder resin are added in an appropriate solvent, followed by dispersing and/or dissolving by means of a known method to prepare a charge generation layer coating liquid, further followed by coating the obtained coating liquid on a surface of a electrically conductive substrate 11 can be used. When an amine compound represented by the general formula (1) is added to a charge generation layer 12, for instance, in an appropriate solvent, the charge generation material, the amine compound represented by the general formula (1) and as needs arise the binder resin are added, followed by dispersing and/or dissolving to prepare a charge generation layer coating liquid, further followed by coating the obtained coating liquid on a surface of a electrically conductive substrate 11, and thereby a charge generation layer 12 can be formed.

Solvents that can be used in the charge generation layer coating liquid include halogenated hydrocarbons such as dichloromethane and dichloroethane; ketones such as acetone, methyl ethyl ketone and cyclohexanone; esters such as ethyl acetate and butyl acetate; ethers such as tetrahydrofuran and dioxane; alkyl ethers of ethylene glycol such as 1,2-dimethoxyethane; aromatic hydrocarbons such as benzene, toluene and xylene; and non-protonic polar solvents such as N,N-dimethylformamide and N,N-dimethylacetamide. Among these, from a consideration on an earth environment problem, halogen-free organic solvents can be preferably used. The solvents can be used singularly or in combination of at least two kinds as a solvent mixture.

The charge generation material may be pulverized by use of a pulverizer before it is dispersed in a solvent. As a pulverizer that is used to pulverize, a ball mill, a sand mill, an attritor, a vibration mill and an ultra-sound disperser can be cited.

As a dispersing device that is used to disperse the charge generation material in a solvent, a paint shaker, a ball mill and a sand mill can be cited. As dispersing conditions at this time, appropriate conditions are selected so that impurities due to abrasion of a vessel used and members that constitute the dispersing device may not be introduced.

As a method of coating a charge generation layer coating liquid, a spray method, a bar coat method, a roll coat method, a blade method, a ring method and a dip coat method can be cited. Among the coating methods, in particular, a dip coat method in which a substrate is dipped in a coating bath filled with the coating liquid, followed by pulling up at a constant speed or gradually varying speed to form a layer on a surface of the substrate, being simple and excellent in the productivity and the manufacturing cost, is preferably used. A device that is used in the dip coat method may be provided with a coating liquid dispersing device typical in an ultrasound generator to stabilize the dispersing property of the coating liquid. The coating method is not restricted thereto and the best method can be appropriately selected in consideration of the physical properties of the coating liquid, the productivity and so on.

A layer thickness of the charge generation layer 12 is preferably 0.05 μm or more and 5 μm or less, and more preferably 0.1 μm or more and 1 μm or less. When the layer thickness of the charge generation layer 12 is less than 0.05 μm, the light absorption efficiency decreases and the sensitivity of the photoreceptor 1 may deteriorate. When the layer thickness of the charge generation layer 12 exceeds 5 μm, since the charge transfer inside of the charge generation layer 12 becomes a rate-determining step in a process where electric charges on a surface of the photoreceptor 10 are erased, the sensitivity of the photoreceptor 1 may deteriorate.

A charge transport layer 13 disposed on the charge generation layer 12 can be constituted including a charge transport material that receives and can transport electric charges generated by the charge generation material contained in the charge generation layer 12 and a binder resin that binds the charge transport material. The charge transport layer 13, as needs arise, may contain an amine compound represented by the general formula (1).

The charge transport material, as far as it can transport electric charges generated by the charge generation material, is not particularly restricted, and various compounds can be used. For instance, a carbazole derivative, an oxazole derivative, an oxadiazole derivative, a thiazole derivative, a thiadiazole derivative, a triazole derivative, an imidazole derivative, an imidazolone derivative, an imidazolidine derivative, a bisimidazolidine derivative, a styryl compound, a hydrazone compound, a polycyclic aromatic compound, an indole derivative, a pyrazoline derivative, an oxazolone derivative, a benzimidazole derivative, a quinazoline derivative, a benzofuran derivative, an acrydine derivative, a phenazine derivative, an amino stilbene derivative, a triaryl amine derivative, a triaryl methane derivative, a phenylenediamine derivative, a stilbene derivative and a benzidine derivative can be cited. Furthermore, polymers that have a group generated from these compounds in a main chain or a side chain, for instance, poly (N-vinyl carbazole), poly(1-vinylpyrene) and poly(9-vinyl anthracene) can be cited as well. The charge transport materials may be used singularly or in combination of at least two kinds.

As a binder resin that constitutes the charge transport layer 13, ones excellent in the compatibility with the charge transport material are selected and used. As binder resins that are used in the charge transport layer 13, for instance, a polymethylmethacrylate resin, a polystyrene resin, a vinyl polymer resin such as a polyvinyl chloride resin and a vinyl copolymer resin containing two or more of repetition units that constitute the foregoing resins, a polycarbonate resin, a polyester resin, a polyester carbonate resin, a polysulfone resin, a phenoxy resin, an epoxy resin, a silicone resin, a polyarylate resin, a polyamide resin, a polyether resin, a polyurethane resin, a polyacrylamide resin and a phenolic resin can be cited. Furthermore, thermosetting resins obtained by partially crosslinking these resins can be cited as well. Among the resins, a polystyrene resin, a polycarbonate resin, a polyarylate resin or a polyphenylene oxide is $10^{13}$ Ω·cm or more in the volume resistivity, that is, excellent in the electrical insulating property and also in the film forming property and the potential characteristics; accordingly, these can be preferably used. The binder resins may be used singularly or in a combination of two or more kinds thereof.

In the charge transport layer 13, a ratio of a weight A of the charge transport material to a weight B of the binder resin, A/B, is preferably 10/30 or more and 10/12 or less. When the ratio A/B is far below 10/30 and a ratio of the binder resin becomes excessively high, the sensitivity of the photoreceptor 1 may deteriorate. Furthermore, in the case of the charge transport layer 13 being formed by means of the dip coat method, when the ratio A/B is less than 10/30, since the viscosity of the coating liquid goes up and the coating speed goes down, the productivity may be very much deteriorated. Still furthermore, when an amount of a solvent in the coating liquid is increased in order to suppress the viscosity of the coating liquid from going up, the brushing is caused, and in a formed charge transport layer 13 the white turbidity may be caused. Furthermore, when the ratio A/B far exceeds 10/12 and a ratio of the binder resin becomes too low, the press life of the photosensitive layer 10 is deteriorated and a film wear amount due to repeated use increases, resulting in the deterioration of the charging property of the photoreceptor 1.

In the charge transport layer 13, within a range in which the preferable characteristics of the invention are not damaged, various kinds of additives such as a plasticizer, a leveling agent or fine particles of an inorganic compound or an organic compound can be added. When the plasticizer or the leveling agent is added, the film forming property, the flexibility and/or surface smoothness of the charge transport layer 13 can be improved. When fine particles of an inorganic compound or an organic compound are added, the mechanical strength of the charge transport layer 13 can be enhanced and the electric characteristics can be improved. As the plasticizers, for instance, a dibasic acid ester such as phthalic acid ester, a fatty acid ester, a phosphoric acid ester, a halogenated paraffin and an epoxy type plasticizer can be cited. As the leveling agents, for instance, a silicone base leveling agent can be cited.

The charge transport layer 13, for instance, similarly to the case where the charge generation layer 12 is formed by coating, can be formed in such a manner that, in an appropriate solvent, the charge transport material and the binder resin, and as needs arise an amine compound represented by the general formula (1) and the above described additive are dissolved and/or dispersed to prepare a charge transport layer coating liquid, and an obtained coating liquid is coated on a surface of the charge generation layer 12.

As the solvent that can be used in the charge transport layer coating liquid, aromatic hydrocarbons such as benzene, toluene, xylene and monochlorobenzene; halogenated hydrocarbons such as dichloromethane and dichloroethane; ethers such as tetrahydrofuran, dioxane and dimethoxy methyl ether; and non-protonic polar solvents such as N, N-dimethylformamide can be cited. Among these, from a consideration on an earth environment problem, halogen-free organic solvents can be preferably used. The solvents can be used singularly or in combination of at least two kinds as a solvent mixture. Furthermore, to the solvent, as needs arise, a solvent such as alcohols, acetonitrile or methyl ethyl ketone can be further added to use.

As a method of coating a charge transport layer coating liquid, a spray method, a bar coat method, a roll coat method, a blade method, a ring method and a dip coat method can be cited. Among the coating methods, in particular, since the dip coat method is excellent in various points as mentioned above, the dip coat method can be preferably used when the charge transport layer 13 is formed as well.

A layer thickness of the charge transport layer 13 is preferably 5 μm or more and 50 μm or less and more preferably 10 μm or more and 40 μm or less. When the layer thickness of the charge transport layer 13 is less than 5 μm, the charge retention capability of a photoreceptor surface may be deteriorated. When the layer thickness of the charge transport layer 13 exceeds 50 μm, the resolution power of the photoreceptor 1 may be deteriorated.

In a laminate type photoconductive layer 14, within a range in which preferable characteristics of the invention are not damaged, at least one kind of an electron receiving material and sensitizer such as a dye may be added. When a sensitizer is added, the sensitivity of the photoreceptor 1 can be improved, and an increase in the rest potential and the fatigue due to the repeated use can be further suppressed, resulting in improving the electrical durability. The sensitizer may be added in any one of the charge generation layer 12 and the charge transport layer 13 that constitute the laminate type photoconductive layer 14, or in both of the charge generation layer 12 and the charge transport layer 13.

As the electron receiving material, for instance, acid anhydrides such as succinic anhydride, maleic anhydride, phthalic anhydride, and 4-chlornaphthalic acid anhydride; cyano compounds such as tetracyanoethylene and terephthalmalondinitrile; aldehydes such as 4-nitrobenzaldehyde; anthraquinones such as anthraquinone and 1-nitroanthraquinone; polycyclic or heterocyclic nitro compounds such as 2,4,7-trinitrofluorenone and 2,4,5,7-tetranitrofluorenone, or electron attracting materials such as a diphenoquinone compound can be used. Furthermore, ones obtained by polymerizing the electron attracting materials can be used.

As the dye, for instance, a xanthene base dye, a thiazine dye, a triphenylmethane dye, a quinoline base pigment or an organic photoconductive compound such as copper phthalocyanine can be used. The organic photoconductive compounds play a role of an optical sensitizer.

The photosensitive layer 10, in the embodiment, is constituted of a laminate type photoconductive layer 14 that is formed by laminating a charge generation layer 12 and a charge transport layer 13 on an electrically conductive substrate 11 in this order. The photosensitive layer 10, without restricting to the foregoing configuration, may be constituted of a laminate type photoconductive layer that is formed by laminating a charge transport layer 13 and a charge generation layer 12 on an electrically conductive substrate 11 in this order.

Figure 2:
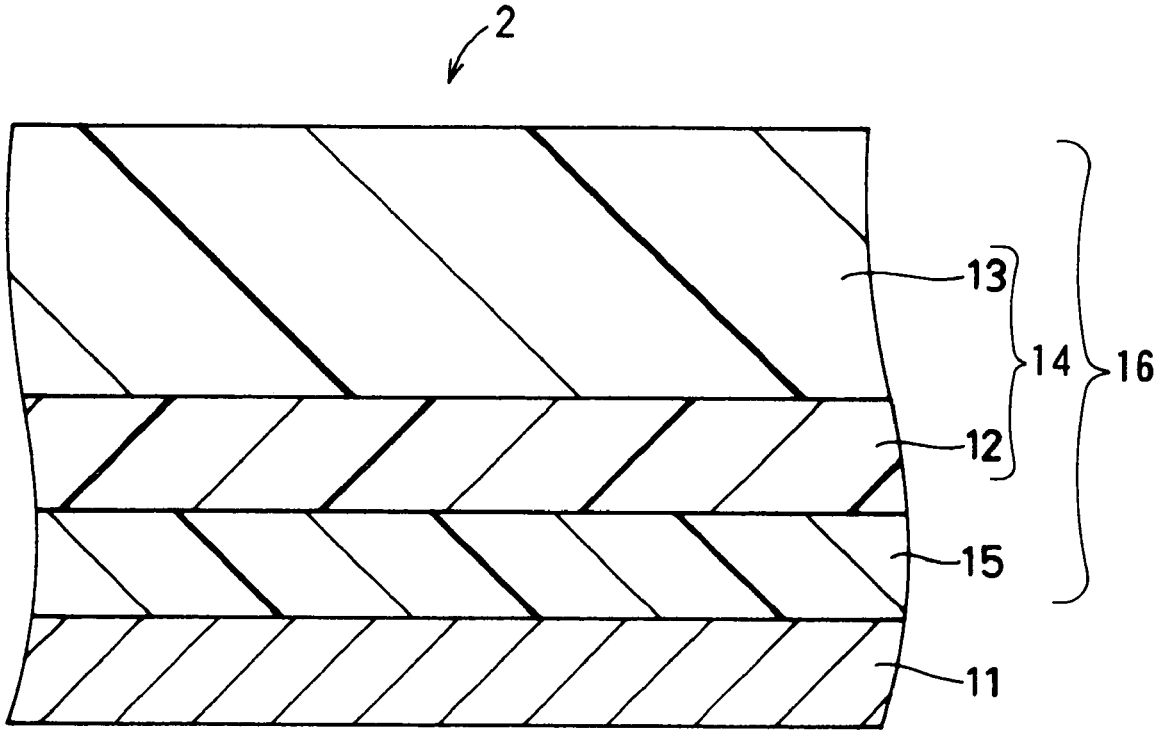
FIG. 2 is a partial sectional view schematically showing a configuration of an electrophotographic photoreceptor that is a second embodiment of the invention.

FIG. 2 is a partial sectional view schematically showing a configuration of an electrophotographic photoreceptor 2 that is a second embodiment of the invention. The electrophotographic photoreceptor 2 according to the embodiment is similar to the electrophotographic photoreceptor 1 according to the first embodiment of the invention as shown in FIG. 1; accordingly, corresponding portions are given the same reference numerals and descriptions thereof will be omitted.

A remarkable point in the electrophotographic photoreceptor 2 is that between the electrically conductive substrate 11 and the laminate type photoconductive layer 14 an intermediate layer 15 is disposed. That is, in the embodiment, a photosensitive layer 16 is constituted including the intermediate layer 15 laminated on the electrically conductive substrate 11 and the laminate type photoconductive layer 14 laminated on the intermediate layer 15.

For instance, when the intermediate layer 15 is not disposed between the electrically conductive substrate 11 and the laminate type photoconductive layer 14, in some cases, electric charges are injected from the electrically conductive substrate 11 to the laminate type photoconductive layer 14 to deteriorate the charging properties of the photoreceptor 2, surface charges of a portion other than a portion that is exposed are diminished, and thereby an image defect such as fogging may occur. In particular, when an image is formed by use of a reversal development process, toner adheres to a portion of which surface charges are diminished owing to the exposure to form a toner image. Accordingly, when the surface charges are diminished owing to a factor other than the exposure, it is feared that the image fogging called black spots that are caused when the toner adheres to a white background to generate minute black spots is caused and the image quality is drastically deteriorated. Thus, when the intermediate layer 15 is not disposed between the electrically conductive substrate 11 and the laminate type photoconductive layer 14, owing to a defect of the electrically conductive substrate 11 or the laminate type photoconductive layer 14, the charging properties in minute regions may be deteriorated, the image fogging such as the black spots may be generated, and in some cases a fatal image defect may be caused.

In the photoreceptor 2 according to the embodiment, as mentioned above, the intermediate layer 15 is disposed between the electrically conductive substrate 11 and the laminate type photoconductive layer 14; accordingly, the electric charges can be inhibited from being injected from the electrically conductive substrate 11 to the laminate type photoconductive layer 14. As a result, the charging properties of the photoreceptor 2 can be inhibited from deteriorating, the surface charges are suppressed from decreasing in a portion other than an exposed portion, and thereby the defect such as the image fogging can be inhibited from occurring.

Furthermore, like in the embodiment, when the intermediate layer 15 is disposed on a surface of the electrically conductive substrate 11, a uniform surface can be obtained by covering defects on a surface of the electrically conductive substrate 11. Accordingly, the film forming properties of the laminate type photoconductive layer 14 can be enhanced. Still furthermore, the intermediate layer 15 works as an adhesive that adheres the electrically conductive substrate 11 and the laminate type photoconductive layer 14; accordingly, the laminate type photoconductive layer 14 can be suppressed from peeling off the electrically conductive substrate 11.

In the embodiment as well, the photosensitive layer 16 contains an amine compound represented by the general formula (1). The amine compound represented by the general formula (1) may be contained in any one of the intermediate layer 15, the charge generation layer 12 and the charge transport layer 13 that constitute the photosensitive layer 16, alternatively, may be contained in all of the intermediate layer 15, the charge generation layer 12 and the charge transport layer 13.

In particular, the amine compound represented by the general formula (1) is contained in at least one of the charge generation layer 12 and the charge transport layer 13, and preferably in the charge transport layer 13. Thus, when the amine compound represented by the general formula (1) is allowed to be contained in at least one of the charge generation layer 12 and the charge transport layer 13, an ion pair generation reaction between an oxidizing gas and the charge transport material, which accompanies an electron transfer, and/or absorption of the oxidizing gas by the charge generation material can be effectively suppressed from occurring. Accordingly, in comparison with the case where the amine compound represented by the general formula (1) is not contained in the charge generation layer 12 and the charge transport layer 13, the oxidizing gas resistance such as the ozone resistance and the nitrogen oxide resistance of the photoreceptor 2 can be improved.

An amount of the amine compound represented by the general formula (1) used in the photosensitive layer 16, similarly to the first embodiment, is preferably in the range of 1 part by weight or more and 20 parts by weight or less to 100 parts by weight of the charge transport material.

In the intermediate layer 15, a resin layer made of various kinds of resin materials or an alumite layer can be used. The resin materials that constitute the resin layer used as the intermediate layer 15 include resins such as a polyethylene resin, a polypropylene resin, a polystyrene resin, an acrylic resin, a polyvinyl chloride resin, a polyvinyl acetate resin, a polyurethane resin, an epoxy resin, a polyester resin, a melamine resin, a silicone resin, a polyvinyl butyral resin and a polyamide resin; and copolymer resins including at least two repetition units that form the foregoing resins. Furthermore, casein, gelatin, polyvinyl alcohol and ethyl cellulose can be also cited. Among the resins, a polyamide resin can be preferably used and particularly an alcohol-soluble nylon resin can be preferably used. As preferable alcohol-soluble nylon resins, so-called copolymer nylons that are obtained by copolymerizing, for instance, 6-nylon, 6,6-nylon, 6,10-nylon, 11-nylon and 12-nylon; and resins obtained by chemically modifying nylon resins such as N-alkoxymethyl-modified nylon and N-alkoxyethyl-modified nylon can be cited.

In the intermediate layer 15, particles such as metal oxide particles are preferably contained. When the particles are contained in the intermediate layer 15, the volume resistivity of the intermediate layer 15 can be controlled and thereby electrical charges can be assuredly inhibited from injecting from the electrically conductive substrate 11 into the laminate type photoconductive layer 14, and the electrical characteristics of the photoreceptor 2 can be maintained under various kinds of environment and thereby the environmental stability can be improved. As the metal oxide particles, for instance, particles of titanium oxide, aluminum oxide, aluminum hydroxide and tin oxide can be cited.

The intermediate layer 15 can be formed in such a manner that, for instance, in an appropriate solvent, the resin and, as needs arise, various kinds of additives such as an amine compound represented by the general formula (1) and metal oxide particles are added, dissolved and/or dispersed to prepare an intermediate layer coating liquid, and the coating liquid is coated on a surface of the electrically conductive substrate 11.

As the solvents for the intermediate coating liquid, water or various kinds of organic solvents, or solvent mixtures thereof can be used. Among these, a single solvent such as water, methanol, ethanol or butanol, or a solvent mixture of water and alcohols, at least two kinds of alcohols, acetone or dioxolane and alcohols, or a chlorine base solvent such as dichloroethane, chloroform or trichloroethane and alcohols is preferable. In particular, from a consideration on the earth environment problem, a non-halogen base organic solvent is preferably used.

As a method of dispersing the particles such as metal oxide particles in a solvent, a known dispersing method that uses a ball mill, a sand mill, an attritor, a vibration mill, an ultrasound dispersing device or a paint shaker can be used.

In the intermediate layer coating liquid, a ratio of a total weight C of the resin and the metal oxide to a weight D of a solvent that is used in the intermediate layer coating liquid, C/D, is preferably in the range of 1/99 to 40/60, and more preferably in the range of 2/98 to 30/70. Furthermore, a ratio of a weight E of the resin to a weight F of the metal oxide, E/F, is preferably in the range of 90/10 to 1/99, and more preferably in the range of 70/30 to 5/95.

As a method of coating the intermediate layer coating liquid, a spray method, a bar coat method, a roll coat method, a blade method, a ring method and a dip coat method can be cited. Among the coating methods, since, in particular, the dip coat method, as mentioned above, is relatively simple and excellent in the productivity and the cost, it can be used when the intermediate layer 15 is formed as well.

A layer thickness of the intermediate layer 15 is preferably 0.01 μm or more and 20 μm or less, and more preferably 0.05 μm or more and 10 μm or less. When the layer thickness of the intermediate layer 15 is thinner than 0.01 μm, substantially it does not work as the intermediate layer 15, uniform surface property cannot be obtained by covering defects of the electrically conductive substrate 11, electric charges may not be inhibited from injecting from the electrically conductive substrate 11 to the laminate type photoconductive layer 14, and thereby there is a fear in that the charging properties of the photoreceptor 2 are deteriorated. When the layer thickness of the intermediate layer 15 is made thicker than 20 μm, in the case of the intermediate layer 15 being formed owing to the dip coat method, since the intermediate layer 15 is formed with difficulty and the laminate type photoconductive layer 14 cannot be formed uniformly on the intermediate layer 15, the sensitivity of the photoreceptor 2 may be unfavorably deteriorated.

Figure 3:
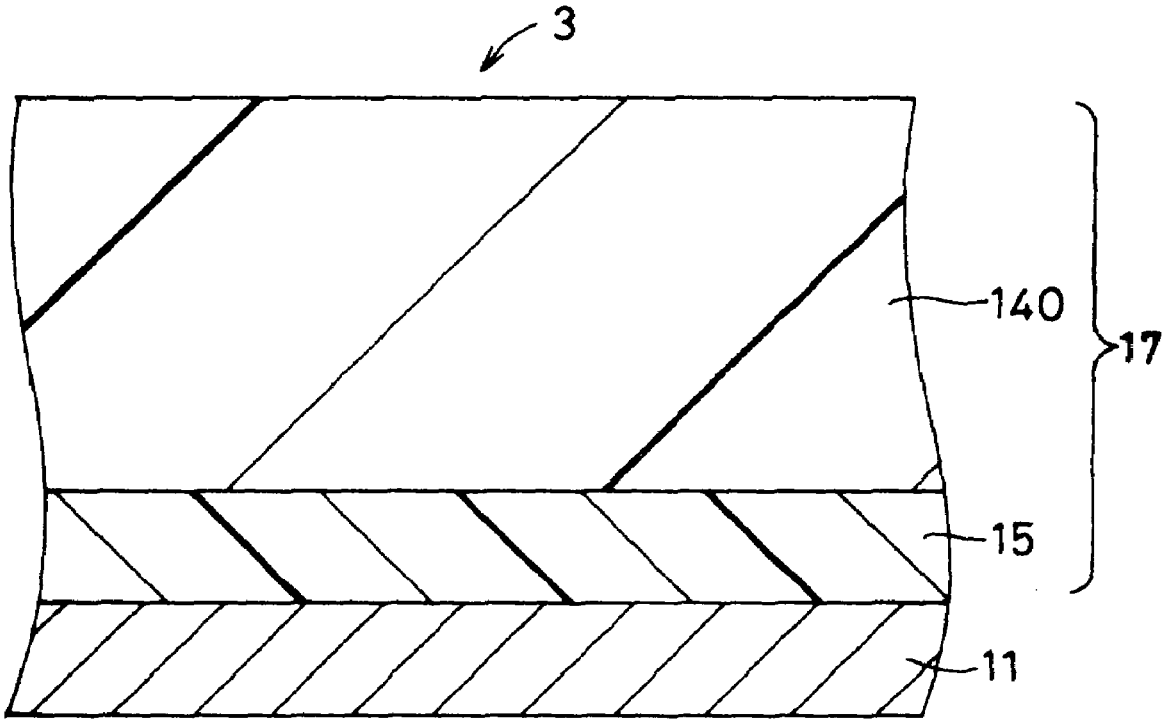
FIG. 3 is a partial sectional view schematically showing a configuration of an electrophotographic photoreceptor that is a third embodiment of the invention.

FIG. 3 is a partial sectional view schematically showing a configuration of an electrophotographic photoreceptor 3 that is a third embodiment of the invention. The electrophotographic photoreceptor 3 according to the embodiment is similar to the electrophotographic photoreceptor 2 according to the second embodiment shown in FIG. 2; accordingly, corresponding portions are given the same reference numerals and descriptions thereof will be omitted.

A remarkable point in the electrophotographic photoreceptor 3 is in that on an intermediate layer 15 a single layer type photoconductive layer 140 made of a single layer that contains both of the charge generation material and the charge transport material is disposed. That is, the photoreceptor 3 is a single layer type photoreceptor. The intermediate layer 15 and the single layer type photoconductive layer 140 constitute a photosensitive layer 17.

The single layer type photoreceptor 3 according to the embodiment is preferable as a photoreceptor for a positively charged image forming device that is less in the ozone generation, and since a layer that is coated on the intermediate layer 15 is only one layer of the single layer type photoconductive layer 140, the production cost and yield are superior to the laminate type photoreceptor 2 according to the second embodiment.

In the embodiment as well, the photosensitive layer 17 contains the amine compound represented by the general formula (1). The amine compound represented by the general formula (1) may be contained in any one of the intermediate layer 15 and the single layer type photoconductive layer 140 that constitute the photosensitive layer 17, alternatively, may be contained in both of the intermediate layer 15 and the single layer type photoconductive layer 140. In particular, the amine compound represented by the general formula (1) is preferably contained in the single layer type photoconductive layer 140. Thus, when the amine compound represented by the general formula (1) is contained in the single layer photoconductive layer 140, an ion pair generation reaction between an oxidizing gas and a charge transport material, which accompanies an electron transfer, and absorption of the oxidizing gas by the charge generation material can be effectively suppressed from occurring. Accordingly, in comparison with the case where the amine compound represented by the general formula (1) is not contained in the single layer type photoconductive layer 140, the oxidizing gas resistance such as the ozone resistance and the nitrogen oxide resistance of the photoreceptor 3 can be improved.

The amine compound represented by the general formula (1), similarly in the first embodiment, is preferably used in the range of 1 part by weight or more and 20 parts by weight or less to 100 parts by weight of the charge transport material. In particular, when the amine compound represented by the general formula (1) is added to the single layer type photoconductive layer 140, the amine compound represented by the general formula (1), similarly to the case in the charge transport layer 13 in the first embodiment, is preferably contained in the range of 1 part by weight or more and 20 parts by weight or less to 100 parts by weight of the charge transport material.

The single layer type photoconductive layer 140 can be formed by adhering the charge generation material and the charge transport material, and as needs arise the amine compound represented by the general formula (1) with a binder resin. As the binder resin, ones exemplified as the binder resin of the charge transport layer 13 in the first embodiment can be used. A ratio of a weight A' of the charge transport material and a weight B' of the binder resin in the single layer type photoconductive layer 140, A'/B', similarly to the ratio of a weight A of the charge transport material to a weight B of the binder resin in the charge transport layer 13 in the first embodiment, A/B, is preferably in the range of 10/12 to 10/30.

In the single layer type photoconductive layer 140, similarly to the charge transport layer 13 according to the first embodiment, various kinds of additives such as a plasticizer, a leveling agent, fine particles of an inorganic compound or an organic compound, an electron receiving material, and a sensitizer such as a dye may be added.

The single layer photoconductive layer 140 can be formed according to a method similar to that used in the charge transport layer 13 disposed to the photoreceptor 1 of the first embodiment. For instance, in an appropriate solvent such as a solvent that is used in the charge transport layer coating liquid, the charge generation material, the charge transport material and the binder resin, and as needs arise the amine compound represented by the general formula (1) and various kinds of additives are added, followed by dissolving and/or dispersing to prepare a photoconductive layer coating liquid, the coating liquid is coated on a surface of the intermediate layer 15 by means of the dip coat method, and thereby a single layer type photoconductive layer 140 can be formed.

A layer thickness of the single layer type photoconductive layer 140 is preferably 5 μm or more and 100 μm or less, and more preferably 10 μm or more and 50 μm or less. When the layer thickness of the single layer type photoconductive layer 140 is less than 5 μm, the charge retention capability of a photoreceptor surface may be deteriorated. When the layer thickness of the single layer type photoconductive layer 140 exceeds 100 μm, the productivity thereof may be deteriorated.

Figure 4:
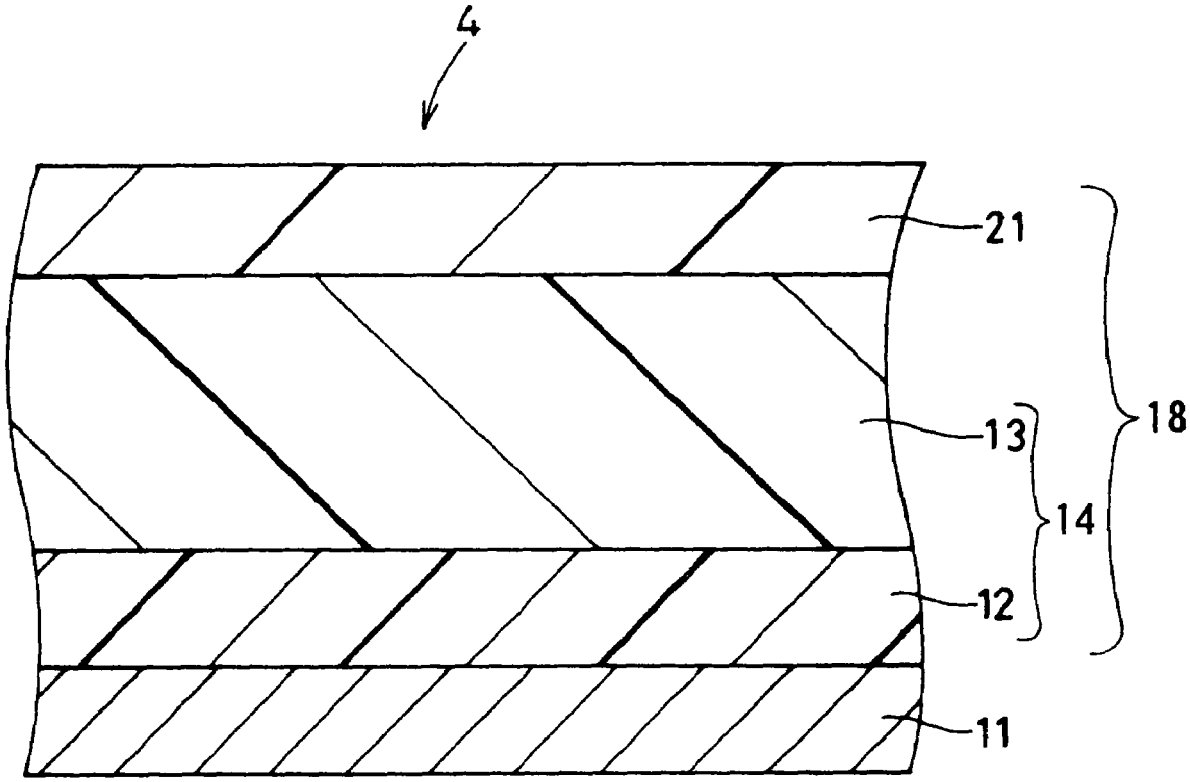
FIG. 4 is a partial sectional view schematically showing a configuration of an electrophotographic photoreceptor that is a fourth embodiment of the invention.

FIG. 4 is a partial sectional view schematically showing a configuration of an electrophotographic photoreceptor 4 that is a fourth embodiment of the invention. The electrophotographic photoreceptor 4 according to the embodiment is similar to the electrophotographic photoreceptor 1 according to the first embodiment shown in FIG. 1; accordingly, corresponding portions are given the same reference numerals and descriptions thereof will be omitted.

A point to be marked in the electrophotographic photoreceptor 4 is that, as a top layer of a laminate type photoconductive layer 14 and an outermost layer of a photosensitive layer 18, a surface protective layer 21 is disposed, and thereby the photosensitive layer 18 is constituted including the laminate type photoconductive layer 14 and the surface protective layer 21. Thereby, the wear resistance of the photosensitive layer 18 can be improved.

The photosensitive layer 18, similarly to the photosensitive layer 10 according to the first embodiment, contains an amine compound represented by the general formula (1). Thereby, a photoreceptor 4 that is excellent in the electrical characteristics such as the charging property, the sensitivity and the responsiveness, the oxidizing gas resistance such as the ozone resistance and the nitrogen oxide resistance, and the electrical durability such that even after repetition use the foregoing excellent electrical characteristics are not deteriorated can be realized. In particular, in the embodiment, since a surface protective layer 21 is disposed on a surface of the laminate type photoconductive layer 14, the fatigue and deterioration due to the oxidizing gases such as ozone and nitrogen oxides can be further suppressed and thereby the electrical durability can be improved.

The amine compound represented by the general formula (1) may be contained in any one of a charge generation layer 12, a charge transport layer 13 and the surface protective layer 21 that constitute the photosensitive layer 18, alternatively, may be contained in all of the charge generation layer 12, the charge transport layer 13 and the surface protective layer 21. In particular, the amine compound represented by the general formula (1) is contained in at least one of the charge generation layer 12 and the charge transport layer 13 and preferably in the charge transport layer 13.

An amount of the amine compound represented by the general formula (1) used in the photosensitive layer 18, similarly to the first embodiment, is preferably in the range of 1 part by weight or more and 20 parts by weight or less to 100 parts by weight of the charge transport material 100.

As the surface protective layer 21, a layer that is made of a resin or the like can be used. The resins (hereinafter, referred to also as binder resin) that can be used in the surface protective layer 21 include a polystyrene resin, a polyacetal resin, a polyethylene resin, a polycarbonate resin, a polyarylate resin, a polysulfone resin, a polypropylene resin and a polyvinyl chloride resin can be preferably used. Among these, in view of the wear characteristics and the electrical characteristics, the polycarbonate resin and polyarylate resin are preferable. The resins may be used singularly or in a combination of at least two kinds.

In the surface protective layer 21, in order to improve the wear resistance, filler is preferably added. As the filler, any one of organic filler and inorganic filler can be used. As the organic fillers, powder of a fluorinated resin such as polytetrafluoroethylene, power of a silicone resin and powder of amorphous carbon can be cited. As the inorganic fillers, powders of metal such as copper, tin, aluminum or indium; metal oxides such as silicon dioxide (silica), aluminum oxide (alumina), tin oxide, zinc oxide, titanium oxide, indium oxide, antimony oxide, bismuth oxide, antimony-doped tin oxide and tin-doped indium oxide; and inorganic materials such as alkali metal salt of titanic acid such as potassium titanate can be cited. Among these, from a viewpoint of the wear resistance, the inorganic filler is preferably used. Since the inorganic filler has excellent hardness, when the inorganic filler is used, particularly excellent wear resistance can be obtained. Among the inorganic fillers, metal oxides are preferable, and silicon oxide, aluminum oxide and titanium oxide are particularly preferable.

The filler that is added to the surface protective layer 21, in order to improve the dispersing properties and to modify the surface properties, may be surface-treated with an inorganic material and/or an organic material. As the filler that is surface-treated with an organic material, as ones that are subjected to the water-repellent treatment, one treated with a silane coupling agent, one treated with a fluorinated silane coupling agent and one treated with a higher fatty acid can be cited. As the fillers that are surface-treated with an inorganic material, ones surface treated with alumina, zirconia, tin oxide and silica can be cited.

An average primary particle diameter of the filler that is added to the surface protective layer 21, in view of the light transmittance and the wear resistance of the surface protective layer 21, is preferably 0.01 μm or more and 0.5 μm or less. When the average primary particle diameter of the filler is less than 0.01 μm, since the wear resistance of the surface protective layer 21 cannot be sufficiently obtained, the lifetime of the photoreceptor 4 may become shorter. When the average primary particle diameter of the filler exceeds 0.5 μm, since light irradiated at the exposure tends to be scattered by the surface protective layer 21, the resolution power may be deteriorated.

A content of the filler in the surface protective layer 21 is preferably 5% by weight or more and 50% by weight or less of a total solid content that constitutes the surface protective layer 21, and more preferably 10% by weight or more and 30% by weight or less. When the content of the filler in the surface protective layer 21 exceeds 50% by weight, although the wear resistance becomes excellent, the rest potential may go up. Furthermore, since the light transmittance of the surface protective layer 21 is deteriorated and light irradiated at the exposure cannot sufficiently reach the charge generation layer 12, the sensitivity may be deteriorated. When the content of the filler in the surface protective layer 21 is less than 5% by weight, since the wear resistance of the surface protective layer 21 becomes deficient, the lifetime of the photoreceptor 4 may become shorter.

In the surface protective layer 21, in order to improve the responsiveness, the charge transport material used in the charge transport layer 13 may be added.

The surface protective layer 21 can be formed, for instance, in such a manner that in an appropriate solvent the binder resin and, as needs arise, the filler, the amine compound represented by the general formula (1) and the charge transport material are added, followed by dispersing and/or dissolving to prepare a coating liquid, and the coating liquid is coated on a surface of the laminate type photoconductive layer 14.

A layer thickness of the surface protective layer 21 is preferably 0.1 μm or more and 10 μm or less, and more preferably 1 μm or more and 8 μm or less. Since a photoreceptor is repeatedly used over a long period, the photoreceptor is necessary to be excellent in the mechanical durability and difficult to be worn. However, when a photoreceptor is mounted on an image forming device and used, ozone and nitrogen oxides generated from a corona discharger or the like stick on a surface of the photoreceptor, and thereby so-called image flow where an image flows in an image forming surface direction of a material to be transferred may occur. In order to inhibit the image flow from occurring, the photosensitive layer 18 is constituted so as to wear at a speed higher than a certain definite speed. Accordingly, in view of the repeated use over the long term, the layer thickness of the surface protective layer 21 is preferably set at 0.1 μm or more. When the layer thickness of the surface protective layer 21 is less than 0.1 μm, the surface protective layer 21 disappears in a short period and the lifetime of the photoreceptor 4 may be shortened. Furthermore, when the layer thickness of the surface protective layer 21 is thicker than 10 μm, owing to the repetition use, a rise in the rest potential and a decrease in the resolution power such as a decrease in the fine dot reproducibility may be caused.

The electrophotographic photoreceptor according to the invention, without restricting to configurations of the electrophotographic photoreceptors 1 through 4 according to the first through fourth embodiments shown in the foregoing FIGS. 1 through 4, as far as it contains an amine compound represented by the general formula (1), may be differently constituted.

Figure 5:
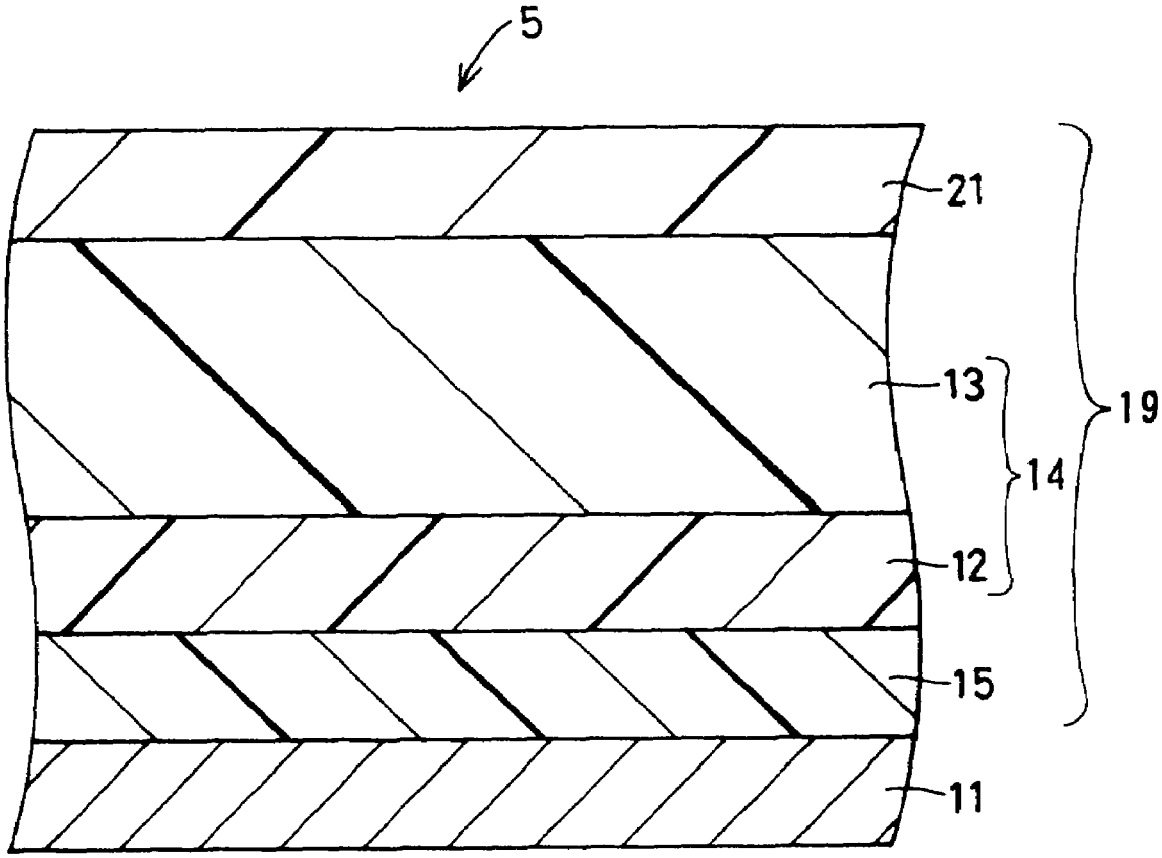
FIG. 5 is a partial sectional view schematically showing a configuration of an electrophotographic photoreceptor providing a photosensitive layer including an intermediate layer, a laminate type photoconductive layer and a surface protective layer.

For instance, like a photoreceptor 5 shown in FIG. 5, on an electrically conductive substrate 11, a photosensitive layer 19 that is constituted including an intermediate layer 15 and a laminate type photoconductive layer 14 similar to the second embodiment shown in the FIG. 2, and a surface protective layer 21 similar to the fourth embodiment shown in the FIG. 4 may be disposed. In this case as well, in the photosensitive layer 19, an amine compound represented by the general formula (1) is contained. The amine compound represented by the general formula (1) may be contained in any one of an intermediate layer 15, a charge generation layer 12, a charge transport layer 13 and a surface protective layer 21 that constitute the photosensitive layer 19, or in all of the intermediate layer 15, the charge generation layer 12, the charge transport layer 13 and the surface protective layer 21. In particular, in at least one of the charge generation layer 12 and the charge transport layer 13, preferably in the charge transport layer 13, the amine compound represented by the general formula (1) is preferably contained.

Figure 6:
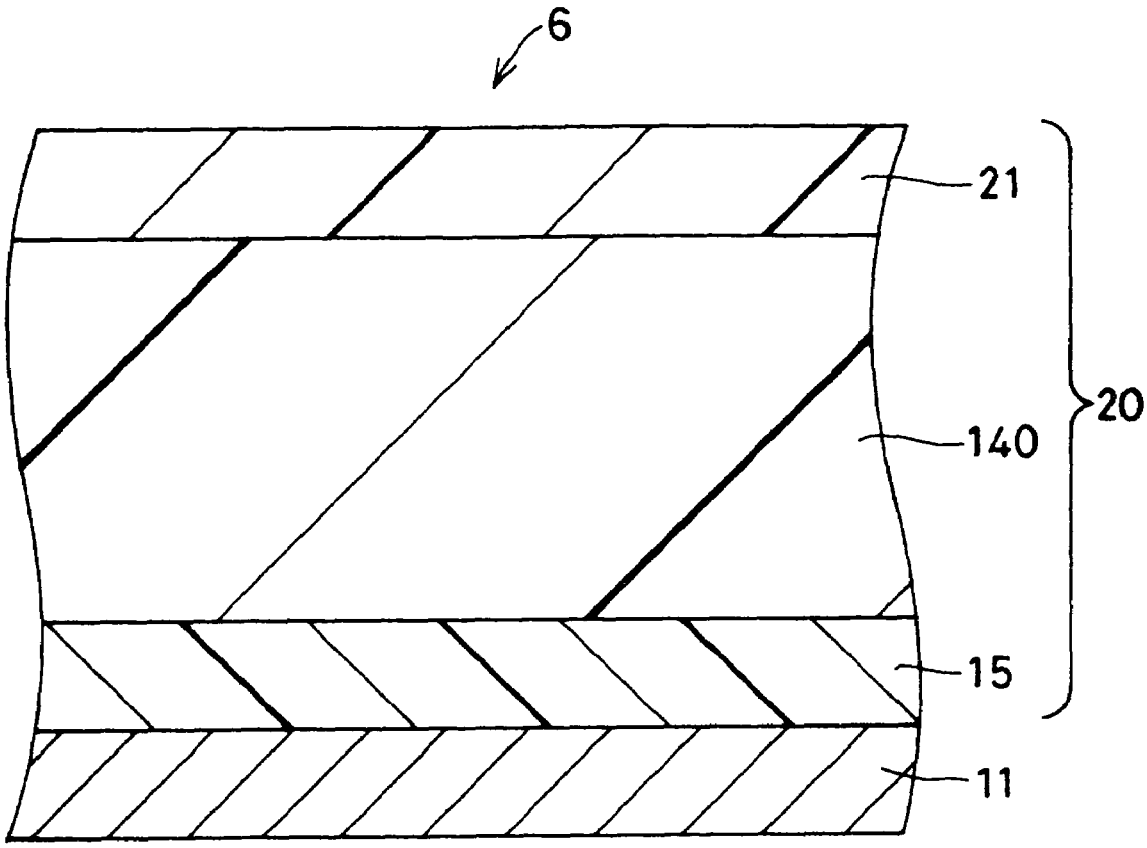
FIG. 6 is a partial sectional view schematically showing a configuration of an electrophotographic photoreceptor providing a photosensitive layer including an intermediate layer, a single layer type photoconductive layer and a surface protective layer.

Furthermore, the electrophotographic photoreceptor according to the invention may have a configuration in which, like a photoreceptor 6 shown in FIG. 6, on an electrically conductive substrate 11, a photosensitive layer 20 that is constituted including an intermediate layer 15 and a single layer type photoconductive layer 140 shown in the FIG. 3 and a surface protective layer 21 similar to the fourth embodiment shown in the FIG. 4 is disposed. In this case as well, in the photosensitive layer 20, an amine compound represented by the general formula (1) is contained. The amine compound represented by the general formula (1) may be contained in any one of an intermediate layer 15, a single layer type photoconductive layer 140 and a surface protective layer 21 which constitute a photosensitive layer 20 or in all of the intermediate layer 15, the single layer photoconductive layer 140 and the surface protective layer 21. In particular, in the single layer type photoconductive layer 140, the amine compound represented by the general formula (1) is preferably added.

In the photosensitive layer 19 or 20 as well, an amount of an amine compound represented by the general formula (1) and used, similarly to the first embodiment, is preferably in the range of 1 part by weight or more and 20 parts by weight or less relative to 100 parts by weight of a charge transport material 100.

In the next place, image forming apparatus according to the invention, which is provided with an electrophotographic photoreceptor according to the invention will be described. The image forming apparatus according to the invention is not restricted to descriptions below.

Figure 7:
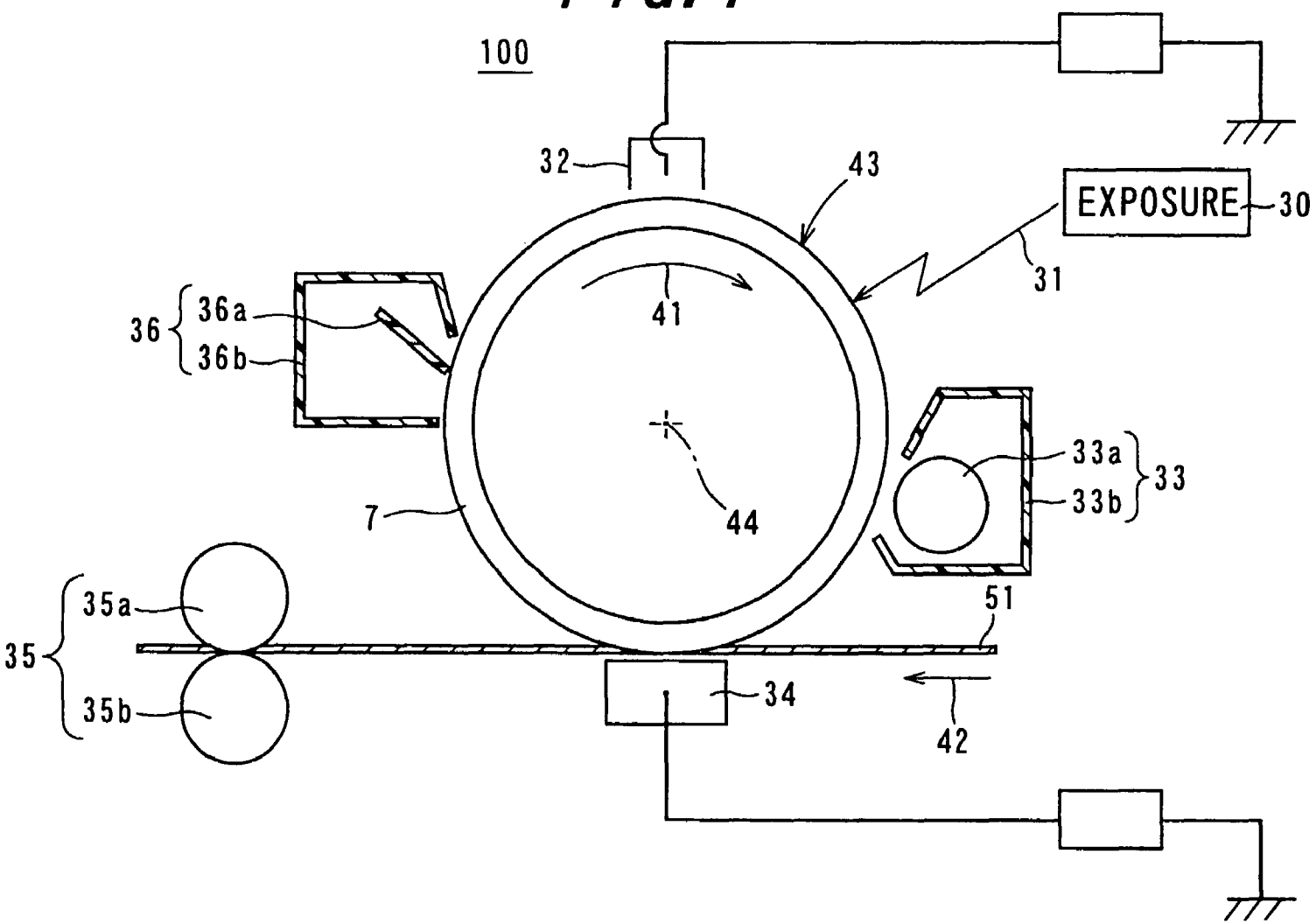
FIG. 7 is a disposition side view schematically showing a configuration of image forming apparatus that is one embodiment of the image forming apparatus according to the invention.

FIG. 7 is a disposition side view schematically showing a configuration of image forming apparatus 100 that is one embodiment of the image forming apparatus according to the invention. The image forming apparatus 100 shown in FIG. 7 mounts, as an electrophotographic photoreceptor according to the invention, a cylindrical photoreceptor 7 having a layer configuration similar to the photoreceptor 1 according to the first embodiment shown in, for instance, the FIG. 1. In what follows, with reference to FIG. 7, a configuration and an image formation operation of the image forming apparatus 100 will be described.

The image forming apparatus 100 includes a photoreceptor 7 that is freely rotatably supported by a not shown apparatus body and a not shown driving unit that drives the photoreceptor 7 around a rotation axis line 44 in an arrow mark 41 direction. The driving unit is provided with, for instance, a motor as a motive energy source, transmits the motive energy from the motor through a not shown gear to a support constituting a core of the photoreceptor 7, and thereby rotates the photoreceptor 7 at a predetermined peripheral velocity.

Around the photoreceptor 7, a charging device 32, an exposing device 30, a developing device 33, a transfer device 34 and a cleaner 36 are disposed in this order from an upstream side to a downstream side in a direction of rotation of the photoreceptor 7 shown with an arrow mark 41. The cleaner 36 is disposed together with a not shown neutralization lamp.

The charging device 32 is a charging unit that charges a surface 43 of the photoreceptor 7 to a predetermined potential. The charging device 32 is a non-contact charging unit such as a corona discharger.

The exposing device 30 is provided with, for instance, a semiconductor laser as a light source and exposes a surface 43 of the charged photoreceptor 7 with light 31 such as a laser beam outputted in accordance with image information from a light source to form a latent image on the surface 43 of the photoreceptor 7.

The developing device 33 is a developing unit that develops the latent image formed on the surface 43 of the photoreceptor 7 with a developing agent to form a toner image that is a visible image. The developing device 33 is provided with a developing roller 33*a* that is disposed facing the photoreceptor 7 and supplies toner to the surface 43 of the photoreceptor 7; and a casing 33*b* that supports the developing roller 33*a* rotatably around a rotation axis line parallel with a rotation axis line 44 of the photoreceptor 7 and houses in an internal space thereof a developing agent including toner.

The transfer device 34 is a transfer unit that transfers a toner image formed on the surface 43 of the photoreceptor 7 from the surface of the photoreceptor 7 on recording paper 51 that that is a transfer material. The transfer device 34 is a non-contact transfer unit that is provided with a charging unit such as a corona discharger, imparts electric charges having the polarity opposite to the toner to the recording paper 51, and thereby transfers the toner image on the recording paper 51.

The cleaner 36 is a cleaning unit that cleans a surface of the photoreceptor 7 after a toner image is transferred, and includes a cleaning blade 36*a* that is pressed against the photoreceptor surface 43 and peels toner remaining on the surface 43 of the photoreceptor 7 after the transfer operation by the transfer device 34 off the surface 43; and a recovering casing 36*b* that accommodates the toner peeled by the cleaning blade 36*a*.

Furthermore, in a direction where the recording paper 51 is transported after the recording paper 51 goes past between the photoreceptor 7 and the transfer device 34, a fixing device 35 that is a fixing unit that fixes a transferred toner image is disposed. The fixing device 35 includes a heating roller 35*a* having a not shown heating unit; and a pressure roller 35*b* that is disposed facing the heating roller 35*a* and pressed against the heating roller 35*a* to form a contact portion.

An image forming operation due to image forming apparatus 100 will be described. In the beginning, in accordance with an instruction from a not shown controller, the photoreceptor 7 is rotated by a driving unit in an arrow mark 41 direction, and, by means of the charging device 32 disposed on a more upstream side than an imaging point of light 31 from the exposing device 30 in a direction of rotation of the photoreceptor 7, a surface 43 thereof is uniformly charged at a predetermined plus or minus potential.

In the next place, in accordance with an instruction from the controller, light 31 is irradiated from the exposing device 30 on the surface 43 of the photoreceptor 7. The light 31 from the light source, based on image information, is scanned repeatedly in a longer direction of the photoreceptor 7 that is a principal scanning direction. When, with the photoreceptor 7 rotating, the light 31 from the light source is scanned repeatedly based on image information, exposure corresponding to the image information can be applied to the surface 43 of the photoreceptor 7. Owing to the exposure, the surface charges of a portion irradiated by the light 31 is reduced, difference between a surface potential of a portion irradiated by the light 31 and a surface potential of a portion on which the light 31 is not irradiated is generated, and thereby a latent image is formed on the surface 43 of the photoreceptor 7. Furthermore, in synchronization with the exposure to the photoreceptor 7, the recording paper 51 is supplied by a not shown transfer device from an arrow mark 42 direction to a transfer position between the transfer device 34 and the photoreceptor 7.

Subsequently, from the developing roller 33*a* of the developing device 33 disposed on a more downstream side in a direction of rotation of the photoreceptor 7 than an imaging point of the light 31 from the light source, toner is supplied on the surface 43 of the photoreceptor 7 on which a latent image is formed. Thereby, a latent image is developed and a toner image that is a visible image is formed on the surface 43 of the photoreceptor 7. When recording paper 51 is supplied between the photoreceptor 7 and the transfer device 34, electric charges having the polarity opposite to the toner are imparted to the recording paper 51 with the transfer device 34, and thereby the toner image formed on the surface 43 of the photoreceptor 7 is transferred on the recording paper 51.

The recording paper 51 on which the toner image is transferred is transported by a transport unit to the fixing device 35 and heated and pressed when the recording paper 51 goes through a contact portion between the heating roller 35*a* and the press roller 35*b* of the fixing device 35. Thereby, the toner image on the recording paper 51 is fixed on the recording paper 51 to form a solid image. The recording paper 51 on which an image is thus formed is outputted outside of the image forming apparatus 100 by a transport unit.

On the other hand, the surface 43 of the photoreceptor 7 that further rotates in a direction of an arrow mark 41 after the toner image is transferred on the recording paper 51 is scraped with a cleaning blade 36*a* provided to the cleaner 36 and cleaned. From the surface 43 of the photoreceptor 7 from which the toner is thus removed, electric charges are removed by light from the neutralization lamp. Thereby, the latent image on the surface 43 of the photoreceptor 7 is erased. Thereafter, the photoreceptor 7 is further rotated, and a series of operations starting from charging the photoreceptor 7 is once more repeated. Thus, images are continuously formed.

The photoreceptor 7 provided to the image forming apparatus 100, as mentioned above, contains the amine compound represented by the general formula (1), is excellent in the electrical characteristics such as the charging properties, the sensitivity and the responsiveness; and in the oxidizing gas resistance. Accordingly, even after repeated use of the photoreceptor, the foregoing excellent electrical characteristics do not deteriorate; that is, the photoreceptor has excellent electrical durability. As a result, high reliability image forming apparatus 100 that can stably form high quality images over a long term can be realized.

Image forming apparatus according to the invention, without restricting to the image forming apparatus 100 shown in the FIG. 7, as far as it can use the photoreceptor according to the invention, may be differently configured.

For instance, in the image forming apparatus 100 according to the embodiment, the charging device 32 is a non-contact charging unit; however, without restricting thereto, a charging device may be a contact type charging unit such as a charging roller. Furthermore, the transfer device 34 is a non-contact transfer unit that transfers without applying a pressing force; however, without restricting thereto, a transfer device may be a contact type transfer unit that transfers by use of the pressing force. As a contact type transfer unit, for instance, one that is provided with a transfer roller and transfers a toner image on the recording paper 51 by applying a voltage to the transfer roller in a state where the transfer roller is pressed from a surface on a side opposite to a contact surface of the recording paper 51 with the surface 43 of the photoreceptor 7 against the photoreceptor 7 and the photoreceptor 7 and the recording paper 51 are pressure-welded can be used.

EXAMPLES

In the next place, with reference to examples and comparative examples, the present invention will be more detailed. However, the invention is not restricted to descriptions below.

Firstly, on electrically conductive substrates made of an aluminum cylinder having an outer diameter of 40 mm and a longer length of 340 mm, under various conditions, photosensitive layers were formed, and thereby photoreceptors were prepared as examples and comparative examples. The photoreceptors will be described.

Example 1

In a solvent mixture of 159 parts by weight of methanol and 106 parts by weight of 1,3-dioxosilane, 7 parts by weight of titanium oxide (Trade name: TTO55A, manufactured by Ishihara Sangyo Co., Ltd.) and 13 parts by weight of a copolymerized nylon resin (Trade name: CMB000, manufactured by Toray Co., Ltd.) were added, followed by dispersing for 8 hr by use of a paint shaker, and thereby an intermediate layer coating liquid was prepared. The coating liquid was filled in a coating bath, an electrically conductive substrate was dipped in the coating bath and pulled up, followed by naturally drying, and thereby an intermediate layer having a layer thickness of 1 μm was formed on the electrically conductive substrate.

In the next place, as a charge generation material 2 parts by weight of an oxotitanium phthalocyanine crystal that has a crystallographic structure showing a distinct diffraction peak at least at a Bragg angle 2θ (error: 2θ±0.2°) 27.2° in an X-ray diffraction spectrum to a Cu—$K_\alpha$ characteristic X-ray (wavelength: 0.154 nm (1.54 Å)), 1 part by weight of a polyvinyl butyral resin (Trade name: Esrex BM-2, manufactured by Sekisui Chemical Co., Ltd.) and 97 parts by weight of methyl ethyl ketone were mixed and dispersed by use of a paint shaker, and thereby a charge generation layer coating liquid was prepared. The coating liquid was coated on the intermediate layer by a dip coat method similar to that in the previously formed intermediate layer, followed by naturally drying, and thereby a charge generation layer having a layer thickness of 0.4 μm was formed. In the invention, the Bragg angle 2θ represents an angle that an incident X-ray and a diffracted X-ray form, that is, a so-called diffraction angle.

In the next place, as a charge transport material 5 parts by weight of a charge transport material 1A represented by the following structural formula (2), as a binder resin 2.4 parts by weight of polyester resin (Trade name: Vylon290, manufactured by Toyobo Co., Ltd.), 5.6 parts by weight of polycarbonate resin (Trade name: G400, manufactured by Idemitsu Kosan Co., Ltd.) and 0.25 part by weight of an amine compound of an exemplified compound No. 14 shown in the Table 2 were mixed, and, with 47 parts by weight of tetrahydrofuran as a solvent, a charge transport layer coating liquid was prepared. The coating liquid was coated on the previously formed charge generation layer by a dip coat method similar to that of the intermediate layer, followed by drying at a temperature 120° C. for 1 hr, and thereby a charge transfer layer having a layer thickness of 22 μm was formed. Thus, a photoreceptor according to example 1 was prepared.

(2)

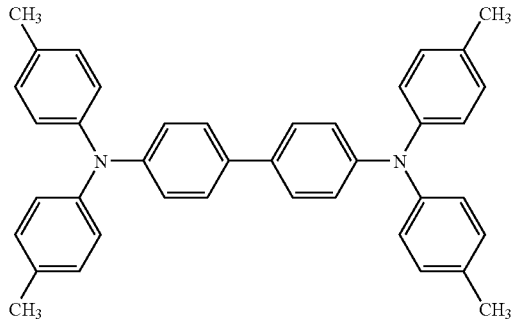

Example 2

Except that, when a charge transport layer was formed, in place of exemplified compound No. 14, an exemplified compound No. 2 shown in Table 1 was used, in a manner similar to example 1, a photoreceptor according to example 2 was prepared.

Example 4

Except that, when a charge transport layer was formed, as a charge transport material, in place of a charge transport material 1A represented by the structural formula (2), a charge transport material 1B represented by a structural formula (3) below was used, in a manner similar to example 1, a photoreceptor according to example 4 was prepared.

(3)

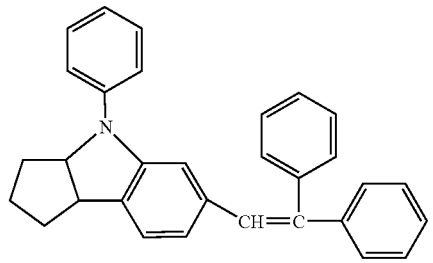

Example 5

Except that, when a charge transport layer was formed, an amount of a compounded exemplified compound No. 14 was changed to 0.05 part by weight, in a manner similar to example 1, a photoreceptor according to example 5 was prepared.

Example 9

Except that, when a charge generation layer was formed, 0.1 part by weight of an amine compound of an exemplified compound No. 14 was added to the charge generation layer coating liquid and, when a charge transport layer was formed, an amine compound of the exemplified compound No. 14 was not used, in a manner similar to example 1, a photoreceptor according to example 9 was prepared.

Comparative Example 1

Except that when a charge transport layer was formed an amine compound of the exemplified compound No. 14 was not used, in a manner similar to example 1, a photoreceptor according to comparative example 1 was prepared.

Comparative Example 2

Except that, when a charge transport layer was formed, as a charge transport material in place of a charge transport material 1A represented by the structural formula (2) a charge transport material 1B represented by the structural formula (3) was used and an amine compound of an exemplified compound No. 14 was not used, in a manner similar to example 1, a photoreceptor according to comparative example 2 was prepared.

Comparative Example 3

Except that, when a charge transport layer was formed, in place of an exemplified compound No. 14, a trialkylamine compound represented by a structural formula (4) below (hereinafter, referred to also as addition compound 2A) was used, in a manner similar to example 1, a photoreceptor according to comparative example 3 was prepared.

$$N(n\text{-}C_{10}H_{21})_3 \quad (4)$$

Comparative Example 4

Except that, when a charge transport layer was formed, in place of an exemplified compound No. 14, an aromatic amine compound represented by a structural formula (5) below (hereinafter, referred to also as addition compound 2B) was used, in a manner similar to example 1, a photoreceptor according to comparative example 4 was prepared.

(5)

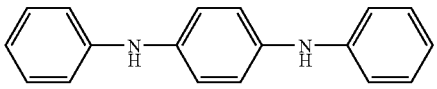

Comparative Example 5

Except that, when a charge transport layer was formed, in place of an exemplified compound No. 14, a hindered amine compound represented by a structural formula (6) below (trade name: TINUVIN622, molecular weight: 3100 to 4000, manufactured by Ciba-Geigy Japan Corp.) was used, in a manner similar to example 1, a photoreceptor according to comparative example 5 was prepared. In what follows, a hindered amine compound represented by the structural formula (6) below will be referred to also as an addition compound 2C. The TINUVIN622 is a mixture of compounds having m=11 to 14 in the structural formula (6) below.

(6)

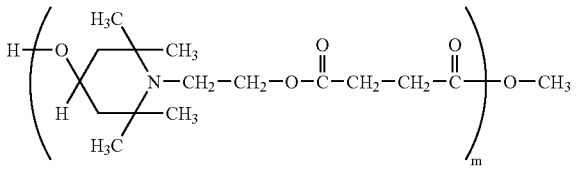

(In the formula, m denotes an integer from 11 to 14.)

Comparative Example 6

Except that, when a charge transport layer was formed, in place of an exemplified compound No. 14, a tertiary amine compound represented by a structural formula (7) below (hereinafter, referred to also as addition compound 2D) was used, in a manner similar to example 1, a photoreceptor according to comparative example 6 was prepared.

(7)

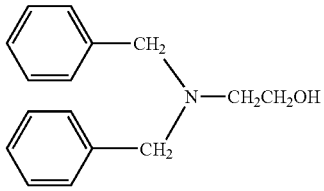

Comparative Example 7

Except that, when a charge transport layer was formed, in place of an exemplified compound No. 14, a hindered phenol compound represented by a structural formula (8) below (hereinafter referred to also as addition compound 2E) was used, in a manner similar to example 1, a photoreceptor according to comparative example 7 was prepared.

(8)

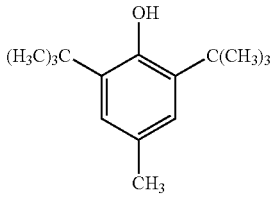

Comparative Example 8

Except that, when a charge transport layer was formed, in place of an exemplified compound No. 14, a benzotriazole compound represented by a structural formula (9) below (hereinafter referred to also as addition compound 2F) was used, in a manner similar to example 1, a photoreceptor according to comparative example 8 was prepared. In the structural formula (9) below, t-Bu denotes a t-butyl group.

(9)

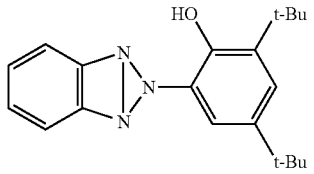

Comparative Example 9

Except that, when a charge generation layer was formed, in a charge generation layer coating liquid, 0.1 part by weight of a hindered amine compound represented by the structural formula (6) and used in comparative example 5 (addition compound 2C) was added and when a charge transport layer was formed an amine compound of an exemplified compound No. 14 was not used, in a manner similar to example 1, a photoreceptor according to comparative example 9 was prepared.

Each of the photoreceptors thus prepared according to examples 1 through 10 and comparative examples 1 through 9 was mounted on a commercially available digital copy machine (trade name: AR-C280, manufactured by Sharp Corporation) provided with a corona discharger as a charging unit of a photoreceptor and evaluated of initial electrical characteristics and the electrical durability as described below. The foregoing digital copy machine AR-C280 is negative charge image forming apparatus where a surface of a photoreceptor is negatively charged and an image is formed according to a reversal developing process.

In the beginning, a developing device was removed from the digital copy machine (Trade name: AR-C280, manufactured by Sharp Corporation) and instead in a developing site a surface potentiometer (trade name: model 344, manufactured by Trek Japan Corp.) was installed so as to be able to measure a surface potential of a photoreceptor in the image forming process. With this copy machine, under an environment of a temperature of 25° C. and the relative humidity of 20%, a surface potential of a photoreceptor when laser light was not applied to expose was measured as a charging potential $V_0$ (V) and a surface potential of the photoreceptor when the laser light was applied to expose was measured as an exposure potential $V_L$ (V). The foregoing measurement results were taken as evaluation indices of the initial electrical characteristics. The initial electrical characteristics were evaluated in such a manner that the larger an absolute value of the charging potential $V_0$, the more excellent in the charging properties, and the smaller an absolute value of the exposure potential $V_L$, the more excellent in the responsiveness.

In the next place, the surface potentiometer was removed from the copy machine and the developing device was installed once more. By use of the copy machine, a test image of a predetermined pattern was formed on 20,000 of recording sheets. When the copy machine was left for 24 hr after a time when image formation on 20,000 sheets came to completion, the developing device was once more removed and the surface potentiometer was installed to the developing site. Thereby, the charging potential $V_0$ (V) and the exposure potential $V_L$ (V) each were measured, in a similar manner to the initial measurement, of a portion disposed immediately below the corona discharger during 24 hr standing (hereinafter referred to as a portion immediately below the charging device) and a portion disposed in a position other than a position immediately below the corona discharger during 24 hr standing (hereinafter, referred to as a portion outside a portion immediately below the charging device).

From measurement results, with a charging potential $V_0$ of a portion immediately below the charging device being as $V_0$ (1) and a charging potential $V_0$ of a portion outside of a portion immediately below the charging device being as $V_0$ (2), an absolute value of a difference of $V_0$ (1) and $V_0$ (2) was obtained as an amount of charging potential change, $\Delta V_0$ (V) ($=|V_0(2)-V_0(1)|$). Furthermore, with an exposure potential $V_L$ of a portion immediately below the charging device being as $V_L$ (1) and an exposure potential $V_L$ of a portion outside of a portion immediately below the charging device being as $V_L$ (2), an absolute value of a difference of $V_L$ (1) and $V_L$ (2) was obtained as an amount of exposure potential change, $\Delta V_L$ (V) ($=|V_L(2)-V_L(1)|$). The smaller the amount of charging potential change $\Delta V_0$ and the smaller the amount of the exposure potential change $\Delta V_L$, the electrical durability was evaluated as the more excellent.

Results of the evaluations are shown in Table 5. In Table 5, a charge transport material is abbreviated as CTN (charge transport material).

TABLE 5

| | | | Added compound | | | | | (4) | | | |
|---|---|---|---|---|---|---|---|---|---|---|---|
| | | | | | Added | (3) | | (5) | | Amount of change | |
| (1) | | CTM | Kind | (2) | layer | $V_0$ (V) | $V_L$ (V) | $V_0$ (V) | $V_L$ (V) | $\Delta V_0$ (V) | $\Delta V_L$ (V) |
| (6) | 1 | 1A | No. 14 | 5 | (8) | −531 | −75 | −535 | −91 | 15 | 12 |
| | 2 | 1A | No. 2 | 5 | (8) | −534 | −72 | −532 | −82 | 9 | 12 |
| | 3 | 1A | No. 7 | 5 | (8) | −535 | −80 | −538 | −87 | 12 | 9 |
| | 4 | 1B | No. 14 | 5 | (8) | −530 | −83 | −531 | −92 | 11 | 15 |
| | 5 | 1A | No. 14 | 1 | (8) | −532 | −68 | −528 | −74 | 16 | 14 |
| | 6 | 1A | No. 14 | 20 | (8) | −530 | −81 | −533 | −96 | 3 | 7 |
| | 7 | 1A | No. 14 | 0.5 | (8) | −530 | −68 | −523 | −67 | 24 | 7 |
| | 8 | 1A | No. 14 | 23 | (8) | −536 | −90 | −540 | −110 | 2 | 7 |
| | 9 | 1A | No. 14 | 3.6 | (9) | −531 | −73 | −535 | −80 | 10 | 10 |
| | 10 | 1A | No. 2 | 3.6 | (9) | −531 | −70 | −532 | −78 | 8 | 9 |
| (7) | 1 | 1A | None | — | — | −530 | −70 | −525 | −69 | 57 | 22 |
| | 2 | 1B | None | — | — | −530 | −82 | −523 | −81 | 47 | 26 |
| | 3 | 1A | 2A | 5 | (8) | −540 | −120 | −545 | −185 | 30 | 20 |
| | 4 | 1A | 2B | 5 | (8) | −535 | −100 | −540 | −145 | 10 | 15 |
| | 5 | 1A | 2C | 5 | (8) | −531 | −80 | −530 | −123 | 10 | 8 |

TABLE 5-continued

| | | Added compound | | | | | (4) | | | |
|---|---|---|---|---|---|---|---|---|---|---|
| | | | | Added | (3) | | (5) | | Amount of change | |
| (1) | CTM | Kind | (2) | layer | $V_0$ (V) | $V_L$ (V) | $V_0$ (V) | $V_L$ (V) | $\Delta V_0$ (V) | $\Delta V_L$ (V) |
| 6 | 1A | 2D | 5 | (8) | −531 | −102 | −530 | −125 | 20 | 3 |
| 7 | 1A | 2E | 5 | (8) | −530 | −75 | −520 | −67 | 30 | 14 |
| 8 | 1A | 2F | 5 | (8) | −530 | −71 | −523 | −96 | 44 | 41 |
| 9 | 1A | 2C | 3.6 | (9) | −535 | −82 | −530 | −137 | 5 | 4 |

(1) Photoreceptor
(2) Added amount (to 100 parts by weight of CTM)
(3) Initial electrical characteristics
(4) After 24 hr standing after 20,000 sheets image formation
(5) A portion outside of a portion immediately below the charging device
(6) Example
(7) Comparative example
(8) A charge transport layer
(9) A charge generation layer From comparison between examples 1 through 10 and comparative examples 1 and 2, it was found that photoreceptors according to examples 1 through 10, in which an amine compound represented by the general formula (1) was added to a photosensitive layer, when compared with photoreceptors according to comparative examples 1 and 2, in which an amine compound represented by the general formula (1) was not added to a photosensitive layer, are smaller in the amount of charging potential change $\Delta V_0$ and the amount of exposure potential change $\Delta V_L$, and smaller in extents of lowering of $V_0$ and $V_L$ of a portion immediately below the corona discharger after 24 hr standing. From this, it is found that when an amine compound represented by the general formula (1) is added to a photosensitive layer, the photoreceptor can be protected from the oxidizing gases such as ozone, nitrogen oxides or the like emitted from the corona discharger and thereby the photoreceptor can be suppressed from fatiguing and deteriorating. Furthermore, from comparison between examples 1 through 8 and examples 9 and 10, it is found that an effect of an amine compound represented by the general formula (1) in suppressing the fatigue and deterioration of the photoreceptor can be exhibited when the amine compound represented by the general formula (1) is added in any one of the charge generation layer and the charge transport layer.

On the contrary, it is found that photoreceptors according to comparative examples 1 and 2, in comparison with photoreceptors according to examples 1 through 10, are larger in the amount of charging potential change $\Delta V_0$ and the amount of exposure potential change $\Delta V_L$, and are largely lowered in the $V_0$ and $V_L$ of a portion immediately below the corona discharger owing to 24 hr standing. This is assumed that the oxidizing gases such as ozone, nitrogen oxides and the like emitted from the corona discharger drastically damaged the photoreceptor.

Furthermore, from comparison between examples 1 through 4 and comparative examples 3 to 6 and comparison between examples 9 and 10 and comparative example 9, photoreceptors according to examples 1 through 4, 9 and 10, in which an amine compound represented by the general formula (1) is added to a photosensitive layer, in comparison with photoreceptors according to comparative examples 3 through 6 and 9, in which known additive compound 2a, 2B, 2C or 2D is added to a photosensitive layer, are smaller in the absolute value of the initial exposure potential $V_L$ and excellent in the responsiveness. On the other hand, photoreceptors according to comparative examples 3 through 6 and 9, when compared with photoreceptors according to examples 1 through 4, 9 and 10, though the amount of charging potential change $\Delta V_0$ and the amount of exposure potential change $\Delta V_L$ are substantially same, are large in the absolute value of the exposure potential $V_L$ from the beginning, that is, are inferior in the responsiveness and exhibit a large increase in the absolute value of the exposure potential $V_L$ after 20,000 image formation. From this, it is found that, though the additive compounds 2A, 2B, 2C and 2D are effective in suppressing the photoreceptor from fatiguing and deteriorating due to the oxidizing gases such as ozone, nitrogen oxides and the like, when the additive compounds are added in the photosensitive layer, the responsiveness is deteriorated.

Still furthermore, from comparison between examples 1 through 4 and comparative examples 7 and 8, it is found that photoreceptors according to examples 1 through 4, in which an amine compound represented by the general formula (1) is added in a photosensitive layer, when compared with photoreceptors according to comparative examples 7 and 8, in which the additive compound 2E or 2F is added to a photosensitive layer, are small in the amount of charging potential change $\Delta V_0$ and the amount of exposure potential change $\Delta V_L$, that is, are excellent in the electrical durability. On the contrary, it is found that photoreceptors according to comparative examples 7 and 8, in comparison with photoreceptors according to examples 1 through 4, are large in the amount of charging potential change $\Delta V_0$ and the amount of exposure potential change $\Delta V_L$ and are largely deteriorated in the $V_0$ and $V_L$ of a portion immediately below the corona discharger after 24 hr standing. From this, it is found that the additive compounds 2E and 2F do not suppress a photoreceptor from fatiguing and deteriorating owing to the oxidizing gases such as ozone, nitrogen oxides and the like.

Still furthermore, from comparison between examples 1, 5 and 6 and examples 7 and 8, it is found that photoreceptors according to examples 1, 5 and 6, in which an amine compound represented by the general formula (1) is added in a charge transport layer at a ratio in the range of 1 to 20 parts by weight to 100 parts weight of a charge transport material, in comparison with a photoreceptor according to example 7, in which an amine compound represented by the general formula (1) is added less than 1 part by weight, deviated toward smaller side from the range, to 100 parts by weight of a charge transport material, are small in the amount of charging potential change $\Delta V_0$ and can effectively suppress the photoreceptor from fatiguing and deteriorating owing to the oxidizing gases such as ozone, nitrogen gases and the like. Furthermore, it is found that in comparison with a photoreceptor according to example 8, in which an amine compound represented by the general formula (1) is added exceeding 20 parts by weight, deviating toward larger side from the range, to 100 parts by weight of a charge transport material, an absolute value of the exposure potential $V_L$ after 20,000 image formation is small to be excellent in the responsiveness. From this, an amount of an amine compound represented by the general formula (1) added in a photosensitive layer is preferably in the range of 1 part by weight or more and 20 parts by weight or less to 100 parts by weight of a charge transport material that is contained in the photosensitive layer.

Thus, when an amine compound represented by the general formula (1) is contained in a photosensitive layer, an electrophotographic photoreceptor that is excellent in the electrical characteristics such as the charging properties, the sensitivity and the responsiveness, excellent in the oxidizing gas resistance such as the ozone resistance, the nitrogen oxide resistance and the like and excellent in the electrical durability such that even after repeated use the excellent electrical characteristics do not deteriorate can be obtained.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. An electrophotographic photoreceptor comprising:

an electrically conductive substrate; and a photosensitive layer including a photoconductive layer containing a charge generation material and a charge transport material, disposed on the electrically conductive substrate, wherein the photoconductive layer includes 1 part by weight or more and 20 parts by weight or less of an amine compound represented by the following general formula (1) relative to 100 parts by weight of a charge transport material:

(1)

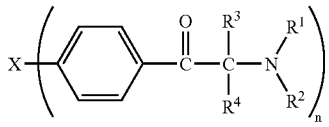

wherein $R^1$ and $R^2$, respectively, represent an alkyl group having 1 to 4 carbon atoms; $R^3$ and $R^4$, respectively, represent an alkyl group that has 1 to 8 carbon atoms and may have an alkoxycarbonyl group having 2 to 5 carbon atoms as a substituent group, or a phenylalkyl group having 7 to 9 carbon atoms; and

X, when n is 1, represents a hydrogen atom, a halogen atom, a hydroxyl group, an alkyl group having 1 to 4 carbon atoms, an alkoxy group having 1 to 4 carbon atoms, an alkylthio group having 1 to 4 carbon atoms, an alkylsulfonyl group having 1 to 4 carbon atoms, a phenylthio group, a phenoxy group or a substituted amino group represented by $—NR^{5a}R^{6a}$, wherein $R^{5a}$ and $R^{6a}$, respectively, represent an alkyl group having 1 to 12 carbon atoms, an alkyl group that has 2 to 4 carbon atoms and alkoxy group having 1 to 4 carbon atoms as a substituent group, an aryl group or an alkylene group that has 4 to 5 carbon atoms and, when couples each other, may have an oxygen atom, an imino group or a N-alkylimino group having 1 to 4 carbon atoms between carbon atoms; and, when n is 2, represents —O—, —S— or an alkylene group having 1 to 4 carbon atoms.

2. The electrophotographic photoreceptor of claim 1, wherein the photoconductive layer includes a charge generation layer containing a charge generation material and a charge transport layer containing a charge transport material, wherein at least one of the charge generation layer and the charge transport layer includes an amine compound represented by a general formula (1).

3. An image forming apparatus comprising:

the electrophotographic photoreceptor of claim 1;

charging means for charging the electrophotographic photoreceptor;

exposure means for applying exposure to the charged electrophotographic photoreceptor; and developing means for developing an electrostatic latent image formed by exposure.

* * * * *